US010022299B2

(12) United States Patent
Eyrard et al.

(10) Patent No.: US 10,022,299 B2
(45) Date of Patent: Jul. 17, 2018

(54) CONTAINER FOR DIALYSIS

(75) Inventors: Thierry Eyrard, Lyons (FR); Bruno Faye, Saint Forgeux (FR); Philippe Laffay, Sainte Foy les Lyon (FR); Benoit Luaire, Sourcieux les Mines (FR)

(73) Assignee: FRESENIUS MEDICAL CARE DEUTSCHLAND GMBH, Bad Homburg (DE)

( * ) Notice: Subject to any disclaimer, the term of this patent is extended or adjusted under 35 U.S.C. 154(b) by 332 days.

(21) Appl. No.: 14/233,528

(22) PCT Filed: Aug. 7, 2012

(86) PCT No.: PCT/EP2012/065481
§ 371 (c)(1),
(2), (4) Date: Jan. 17, 2014

(87) PCT Pub. No.: WO2013/020989
PCT Pub. Date: Feb. 14, 2013

(65) Prior Publication Data

US 2014/0144794 A1 May 29, 2014

Related U.S. Application Data

(60) Provisional application No. 61/522,495, filed on Aug. 11, 2011.

(30) Foreign Application Priority Data

Aug. 11, 2011 (FR) ..... 11 57309

(51) Int. Cl.
*A61J 1/20* (2006.01)
*A61J 1/14* (2006.01)
(Continued)

(52) U.S. Cl.
CPC ..... *A61J 1/20* (2013.01); *A61J 1/1406* (2013.01); *A61J 1/2093* (2013.01); *A61J 1/10* (2013.01);
(Continued)

(58) Field of Classification Search
CPC A61J 1/1406; A61J 1/2093; A61J 1/20; A61J 1/10; A61J 1/2075; A61J 1/201;
(Continued)

(56) References Cited

U.S. PATENT DOCUMENTS 2,659,370 A 11/1953 Smith
3,603,469 A * 9/1971 Magni ..... B65D 51/285 206/222
(Continued)

FOREIGN PATENT DOCUMENTS

CA 2703134 A1 4/2009
CN 1336825 A 2/2002
(Continued)

OTHER PUBLICATIONS

Chinese Office Action dated Aug. 13, 2015 in corresponding Chinese application No. 201280036464.7; with English translation (9 pages) (JP2001/340423A, U.S. Pat. No. 2,659,370A, and EP1710169A1 cited in the Chinese Office Action were cited in the ISR and listed in a previous IDS).
(Continued)

*Primary Examiner* — Adam Marcetich
(74) *Attorney, Agent, or Firm* — Westerman, Hattori, Daniels & Adrian, LLP

(57) ABSTRACT

A container containing a concentrate for dialysis includes a pouch or cartridge containing a solid concentrate of constituents for the dialysis solution, the pouch or cartridge being closed by a connector having a filling channel extending completely through the connector, which is for filling the
(Continued)

Figure 12:
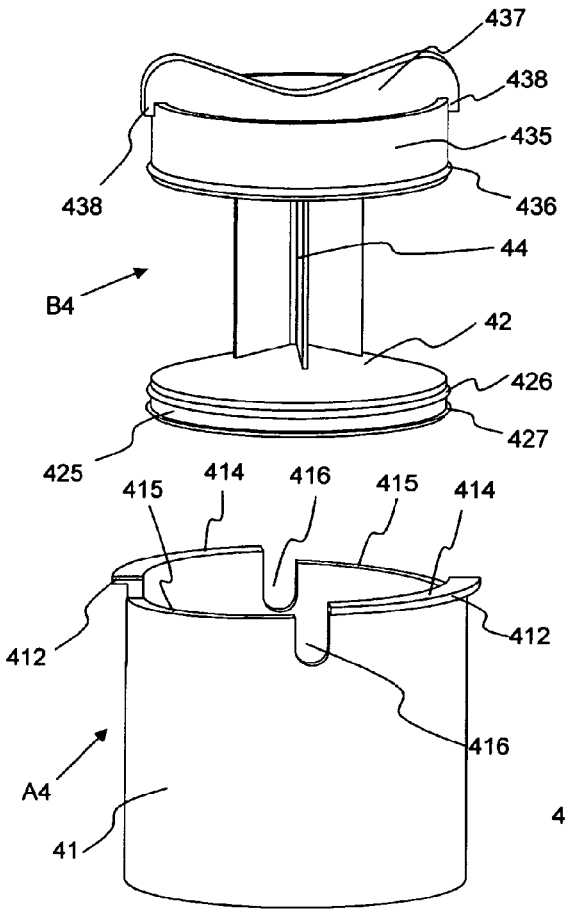

pouch or cartridge with the solid concentrate, means for introducing a solution-forming liquid into the pouch or cartridge and for extracting the solution obtained, these introduction and extraction means having at least one connecting portion for connecting them to a corresponding port of the dialysis machine. The filling channel is closed by a stopper which has a reservoir containing a second constituent or group of constituents for the dialysis solution, and means for producing an outlet opening in the reservoir contacting the inside of the reservoir with the side of the stopper located in the container.

27 Claims, 9 Drawing Sheets

(51) Int. Cl.
*B65D 51/28* (2006.01)
*A61J 1/10* (2006.01)

(52) U.S. Cl.
CPC ..... *A61J 1/1425* (2015.05); *A61J 1/201* (2015.05); *A61J 1/2075* (2015.05); *B65D 51/285* (2013.01); *B65D 51/2807* (2013.01); *B65D 51/2814* (2013.01); *B65D 51/2864* (2013.01); *B65D 51/2878* (2013.01)

(58) Field of Classification Search
CPC .. A61J 1/1425; A61M 1/1656; A61M 1/1666; A61M 1/1668; A61M 1/167; B65D 51/2807; B65D 51/2814; B65D 51/2821; B65D 51/2828; B65D 51/2835; B65D 51/2842; B65D 51/285; B65D 51/2857; B65D 51/2864; B65D 51/2871; B65D 51/2878; B65D 51/2885; B65D 51/2892
See application file for complete search history.

(56) References Cited

U.S. PATENT DOCUMENTS 3,968,820 A * 7/1976 Kolb ..... B65D 21/0237 141/330
3,968,872 A * 7/1976 Cavazza ..... B65D 47/18 206/222
4,048,999 A 9/1977 Köbel
4,195,731 A * 4/1980 Cavazza ..... B65D 51/2814 206/222
4,315,570 A * 2/1982 Silver ..... B65D 81/3222 206/221
4,396,383 A * 8/1983 Hart ..... A61J 1/2093 604/404
4,415,393 A 11/1983 Grimes
4,489,535 A * 12/1984 Veltman ..... A61M 1/1654 206/524.1
4,515,586 A 5/1985 Mendenhall et al.
4,519,499 A * 5/1985 Stone ..... A61J 1/2093 206/219
4,561,110 A 12/1985 Herbert
4,606,734 A 8/1986 Larkin et al.
4,614,515 A 9/1986 Tripp et al.
4,781,679 A * 11/1988 Larkin ..... A61J 1/2089 604/413
4,858,760 A * 8/1989 Di Sturco ..... B65D 51/285 206/222
4,962,852 A * 10/1990 Affaitati ..... B65D 51/2814 206/222
5,038,951 A * 8/1991 Rizzardi ..... B65D 51/285 206/222
5,084,040 A 1/1992 Sutter
5,364,384 A 11/1994 Grabenkort et al.
5,385,564 A * 1/1995 Slater ..... A61M 1/167 128/898
5,766,147 A 6/1998 Sancoff et al.
6,645,191 B1 * 11/2003 Knerr ..... A61J 1/2093 604/410
6,663,743 B1 * 12/2003 Becker ..... A61J 1/2093 156/273.7
7,223,262 B2 5/2007 Brehm et al.
8,215,481 B1 * 7/2012 Knickerbocker .... B65D 51/285 206/219
8,479,943 B2 7/2013 Wilhelm
9,029,333 B2 5/2015 Sugiyama et al.
2002/0012707 A1 1/2002 Duponchelle et al.
2003/0012714 A1 * 1/2003 Taylor ..... A61M 1/1656 422/261
2003/0168120 A1 9/2003 Brehm et al.
2004/0036229 A1 * 2/2004 Takahashi ..... B65D 51/2878 277/628
2004/0104247 A1 * 6/2004 Anderson ..... B65D 51/2835 222/83
2004/0186408 A1 9/2004 Behague et al.
2005/0096625 A1 5/2005 Brandl et al.
2005/0161348 A1 * 7/2005 Morini ..... B65D 41/3438 206/219
2005/0205438 A1 * 9/2005 Hierzer ..... B65D 51/2835 206/222
2005/0211579 A1 * 9/2005 Makita ..... B65D 51/2878 206/219
2005/0215943 A1 9/2005 Brandenburger et al.
2005/0279653 A1 12/2005 Williams-Lucas et al.
2006/0108314 A1 * 5/2006 Cho ..... B65D 51/285 215/228
2006/0172954 A1 * 8/2006 Jensen ..... A61J 1/10 514/23
2006/0210739 A1 * 9/2006 Loffler ..... A61M 1/1654 428/35.7
2007/0003637 A1 * 1/2007 Elisabettini ..... A61K 33/14 424/717
2007/0225673 A1 * 9/2007 Brehm ..... A61M 1/1656 604/408
2008/0009783 A1 1/2008 Branderburger et al.
2008/0093326 A1 * 4/2008 Cho ..... B65D 51/285 215/228
2008/0156763 A1 * 7/2008 Murphy ..... A61J 9/00 215/11.1
2008/0245683 A1 * 10/2008 McKenna ..... B65D 51/2835 206/219
2009/0139951 A1 * 6/2009 Chen ..... B65D 51/2835 215/227
2010/0059394 A1 * 3/2010 Fontana ..... B65D 51/2814 206/222
2010/0069817 A1 * 3/2010 Falkvall ..... A61M 1/167 604/6.11
2010/0120702 A1 5/2010 Sugiyama et al.
2010/0163441 A1 * 7/2010 Kim ..... B65D 51/2892 206/221
2010/0163442 A1 7/2010 Lee et al.
2011/0120302 A1 5/2011 Raiford et al.
2011/0137280 A1 6/2011 Ramella et al.
2011/0266171 A1 * 11/2011 Rovelli ..... B65D 51/2835 206/222
2012/0168327 A1 * 7/2012 Kim ..... B65D 51/2878 206/221
2012/0288572 A1 11/2012 Kugelmann et al.
2013/0183389 A1 7/2013 Carlsson et al.
2013/0190681 A1 * 7/2013 Jansson ..... A61J 1/2093 604/28

FOREIGN PATENT DOCUMENTS

CN 101427978 A 5/2009
CN 102143773 A 8/2011
EP 0395758 A1 11/1990
EP 1344550 A1 9/2003
EP 1572551 A1 1/2004
EP 1642614 A1 4/2006
EP 1710169 A1 10/2006

(56) References Cited

FOREIGN PATENT DOCUMENTS

| | | | |
|---|---|---|---|
| EP | 2585076 | B1 | 3/2015 |
| FR | 1154323 | A | 4/1958 |
| GB | 2317870 | A | 4/1998 |
| JP | S58-169466 | A | 10/1983 |
| JP | S58-501757 | A | 10/1983 |
| JP | 2001-335069 | A | 12/2001 |
| JP | 2001-340423 | A | 12/2001 |
| JP | 2003-275299 | A | 9/2003 |
| JP | 2005-514283 | A | 5/2005 |
| JP | 2005-527301 | A | 9/2005 |
| JP | 2006-521124 | A | 9/2006 |
| JP | 2006-263261 | A | 10/2006 |
| JP | 2009-518252 | A | 5/2009 |
| WO | 83/01416 | A1 | 4/1983 |
| WO | 89/02730 | A1 | 4/1989 |
| WO | 96/40327 | A | 12/1996 |
| WO | 00/57833 | A1 | 10/2000 |
| WO | 2004-005154 | A1 | 1/2004 |
| WO | 2007/144427 | A2 | 12/2007 |
| WO | 2011/073274 | A1 | 6/2011 |

OTHER PUBLICATIONS

International Search Report dated Nov. 23, 2012, issued in corresponding application No. PCT/EP2012/065481.

Taiwanese Office Action dated Apr. 15, 2016 in counterpart Taiwanese Appl. No. 101126929; with English partial translation and partial machine-translation (13 pages) (D1-D4 cited in the Taiwanese Office Action are not listed in this IDS since they are already of record in this application).

International Search Report dated Jul. 30, 2012 in international application PCT/EP2012/058829 corresponding to co-pending U.S. Appl. No. 14/110,399; in English (2 pages).

Chinese Office Action dated Apr. 1, 2015 in Chinese Appl. No. 201280023326.5 corresponding to co-pending U.S. Appl. No. 14/110,399; with English translation (17 pages).

Japanese Office Action dated Feb. 16, 2016 in Japanese Appl. No. 2014-510755 corresponding to co-pending U.S. Appl. No. 14/110,399; with English translation (7 pages).

Office Action dated May 6, 2016 in co-pending U.S. Appl. No. 14/110,399; with PTO892, without returned SB08 (10 pages) (US20030168120A1 to Brehm et al. cited in the Office Action is not listed in this IDS since it is already of record).

Japanese Office Action (Notice of Allowance) dated Jul. 12, 2016 in Japanese Appl. No. 2014-510755 corresponding to co-pending U.S. Appl. No. 14/110,399; with English machine translation (6 pages).

Notice of Allowance dated Sep. 28, 2016 in co-pending U.S. Appl. No. 14/110,399; without returned SB08 (10 pages).

Japanese Office Action dated Mar. 1, 2016 in corresponding Japanese application No. 2014-524367; with English translation (4 pages).

* cited by examiner

CONTAINER FOR DIALYSIS

The invention relates to a container containing a concentrate for dialysis, which container comprises a pouch or a cartridge containing a solid concentrate with constituents of the composition of the dialysis solution, the pouch or the cartridge being closed by a connector provided with a filling channel extending completely through the unit for filling the pouch or the cartridge with the solid concentrate, means for introducing a solution-forming liquid into the pouch or cartridge and for extracting the solution obtained from the pouch or the cartridge, these introduction and extraction means being provided with at least one connecting portion for connecting them to at least one corresponding port on the dialysis machine. The invention also relates to the use made of such a container and to the process for manufacturing extemporaneously a concentrated solution for dialysis.

The invention relates to refills for dialysis machines. Such refills are used to manufacture extemporaneously bicarbonate solutions for dialysis. These refills are made up mainly of a pouch or a cartridge closed by a connector. They generally contain a solid concentrate, such as bicarbonate in the form of powder or granule. The connectors include two lines of fluids. The first serves to introduce water to dissolve the bicarbonate concentrate, while the second is used to draw the saturated solution thus produced. Each fluid line is provided at its outer end with a connecting portion designed to penetrate into a corresponding port on the dialysis machine. The other ends of the fluid lines open into the interior of the pouch or the cartridge. It is necessary to provide a center channel in the connector in order to introduce the solid concentrate into the container during manufacture of the refill. After filling the refill, the center channel is sealingly closed in order to prevent any dirt from entering into the container and polluting its contents. The dialysis machine itself adds water into the cartridge and draws the solution thus formed. The machine then mixes this bicarbonate solution with an acidic liquid concentrate and with water to reach the desired concentration. The acidic concentrate contains an acid and electrolytes, notably glucose.

The concentrated acid solutions containing glucose have two major drawbacks. The first is the fact that the solution is not very stable over time and it becomes colored during storage. The second is due to the fact that medical personnel must manipulate pouches or containers that are rather heavy, since they contain, not only the components of the dialysis, but also water. While there are strong concentrated acids that are lighter to manipulate and less bulky for storage, their stability remains problematic. Moreover, the choice of acid, which must be present in solid form while being physiologically compatible, is limited. In practice, only citric acid can be selected. However, this acid has the disadvantage of influencing blood coagulation.

To work around this problem, it has been proposed in JP 2001-340423 A a container containing two chambers separated by a wall that can be torn or raised at the time of use. The solid glucose is stored in one of the chambers, separated from the other solid components.

Also in the medical field, EP 0 395 758 A1 describes an infusion bag provided with two separate pouches, one containing the perfusion liquid, the other containing a vial containing an antibiotic and closed by a rubber stopper. A passage is provided between the two pouches. The vial is fixed at one of the ends of the passage by an accordion-shaped tubular element that can be crushed. A hollow needle is arranged in this passage, with the tip projecting into the accordion-shaped element and being oriented toward the rubber stopper. The other end of the needle protrudes into the pouch containing the liquid, but it is separated initially from the pouch by a severable barrier. At the time of preparing the mixture, the user pushes the vial toward the passage, simultaneously crushing the accordion-shaped element. The needle then pierces the rubber stopper. Thus, the user only needs to break the severable barrier and shake the pouch several times to solubilize the antibiotic and transfer the mixture into the infusion pouch. This pouch is particularly complicated to use and cannot be easily adapted to a dialysis refill.

The document U.S. Pat. No. 2,659,370 A describes a vial containing a liquid and closed by a stopper that penetrates into the neck of the vial until a flange. This stopper comprises a recess in its face oriented toward the inside of the vial. This recess, provided with a detachable cap, forms a sealed compartment in which can be placed a tablet or a medical preparation. The stopper is further provided with a blind hole that opens on the outer face of the stopper, opposite the recess. The bottom of the blind hole and the recess are separated by a diaphragm. A cap is placed on the neck of the vial and covers the stopper. This cap is provided at its center with a needle that penetrates into the blind hole without touching its bottom. At the time of using the product, the user presses on the top of the cap, causing the downward displacement of the needle that pierces the diaphragm, presses on the tablet so as to push it down, thus forcing the detachable cap to come out of its slot and fall into the vial. The tablet or pharmaceutical preparation can thus fall into the liquid contained in the vial. This method requires that a wall, here, a diaphragm, is pierced so that the needle can reach the container.

This problem of storing two ingredients during storage is also known in other technical areas, notably in the food industry. Thus, it is known from the document EP 1 710 169 A1 a UHT milk bottle whose neck is closed by a film surmounted by a blister containing a biotic product in dehydrated form. The assembly is surmounted by a cap that can be screwed. At the time of consumption, the user twists the cap which rests on the dome of the blister. The cap is provided with a spike that comes to burst the bottom of the blister and the film that closes the bottle. Thus, the biotic product falls into the milk. The user then only needs to open the stopper, remove the rest of the blister and the film to reach the milk/biotic product mixture contained in the bottle. This solution requires, on the one hand, welding of the film on the neck of the bottle, and on the other hand, fixing the blister on this film by welding or gluing. This method cannot be used in filling sites that are not equipped with welding means.

Other documents such as CA 2 703 134 A1 or GB 2 317 870 A propose bottles whose opening is provided with a screw cap incorporating a reservoir. The reservoir is closed in its lower portion by a membrane. A piston is provided inside the reservoir. The lower end of the piston is provided with means for tearing the membrane. Initially, that is to say in the rest position, the upper end of the piston protrude from the cap while its lower end is located above the membrane, at a distance thereof. To prepare the mixture, the upper end of the piston is pushed down into the cap, causing the downward displacement of the lower end of the piston, and consequently, tearing of the membrane. After shaking the container, the cap is unscrewed and the user has access to the contents. This cap has the disadvantage that the spike that was used to tear the membrane protrudes from the cap and risks injuring the user when the cap has been removed. In addition, the membrane must yield easily under the effect of the tearing means. Therefore, it presents an intrinsic fragility so that it risks being torn before it is put in place on the bottle.

The document WO 2004/005154 A1 proposes different alternative solutions. In a first variant, the cap is constituted by a stationary part screwed onto the vial and a rotary part constituting the reservoir. Openings are formed in the upper wall of the stationary part and in the lower part of the movable part. Before use, the openings of the two parts are not aligned and the reservoir is thus closed. At the time of preparing the solution, the rotary part must be rotated to align the openings. The product contained in the reservoir can flow into the container. In a second variant, the reservoir can be moved upwardly relative to the stationary part. Before use, the moving part is pressed against the stationary part and their openings are not aligned. The reservoir is thus closed. If the user lifts the mobile part, an intermediate chamber is produced between the two parts and the product contained in the reservoir can flow into the intermediate chamber, then into the stationary part, and finally into the container. In a third variant, the reservoir has an outlet opening in its lower wall. In addition, a rod extends through the reservoir and protrudes outside the reservoir through the outlet opening. A disc is fixed to the lower end of this opening. The reservoir is placed in a stationary part placed on the neck of the reservoir. Initially, the container is in an upper position and the disc bears against the edge of an opening provided in the stationary part so that the reservoir is closed. To release the contents of the reservoir, the disc must be pushed down or lifted up in the stationary part until the disc moves away from the opening of the stationary part and opens a passage between the reservoir and the container. In these three variants, it is necessary to move the reservoir relative to the vial.

Finally, the same document WO 2004/005154 A1 provides a fourth variant in which the reservoir is screwed directly onto the neck of the container. The lower wall of the reservoir is provided with a frustoconical opening. Its upper portion has a plurality of outlet openings closed by a cap. A rod extends through the reservoir. Its upper end is integral with the cap. Its lower end is provided with a disc-shaped stopper whose circumferential edge has a frustoconical shape complementary to that of the passage-forming opening of the reservoir. In the storage position, the cap is pressed against the reservoir and the stopper of the rod is placed in the opening: the reservoir is closed. In order to obtain the mixture, the user must lift the cap, lifting with it the rod and the stopper, which thus moves away from the passage-forming opening. The contents of the reservoir can flow into the container. To drink the solution, the cap must be kept in its raised position. The liquid passes through the passage-forming opening, through the reservoir, and then leaves it through the outlet openings, which are now opened, and passes through the cap. The document does not indicate how to fill this reservoir. To the extent that it has an opening at the bottom and several openings at the top, all these openings being in closed or in open position at the same time, it seems that it is impossible to fill the reservoir in practice. Consequently, this fourth option does not appear to be applicable industrially.

The objective of the invention to provide a container for dialysis containing two components or groups of components separated during storage, which allows mixing these components at the start of the dialysis. A second objective is to automate the contacting of the components when the refill is put in place into the dialysis machine. A third objective is to ensure sealing such that the products remain sterile, not only during storage, but also when the components are mixed and when the solution is withdrawn. A fourth objective is to allow the manufacture of refills for dialysis containing a solid acidic concentrate which is stable over time and which allows the use of acids other than citric acid.

These objectives are reached according to the invention in that the filling channel is closed by a stopper equipped with a reservoir containing a second constituent or group of constituents of the composition of the dialysis solution. The stopper is also equipped with means for producing in the reservoir an outlet opening which contacts the inside of the reservoir with the side of the stopper located in the container. Such containers can thus contain two groups of components that are separated during storage and that come in contact with each other only at the start of dialysis. Stability problems are thus avoided.

In a preferred embodiment of the invention, the pouch contains a solid concentrate containing glucose and the reservoir of the stopper contains an acid, preferably in liquid form. It is thus possible to choose a liquid or solid acid, and in particular, it is possible to choose hydrochloric acid or acetic acid. Thus, doctors have at their disposal a greater choice of acids and the dialysis solution can be more easily adapted to the needs of the patient.

It is preferable that the introduction means and the extraction means comprise a fluid line for the introduction of a solution-forming liquid into the pouch or the cartridge, and a fluid line for the extraction of the solution obtained from the pouch or the cartridge, each fluid line extending from an orifice located in the pouch or the cartridge to a connecting portion located outside the container, which connecting portions are configured for the connection of each fluid line to a corresponding port of a dialysis machine. In a preferred embodiment of the invention, the two fluid lines are combined into a single fluid line.

It is preferable to place the means for producing the opening at least partly in the reservoir before the opening has been produced. This way, it is not necessary to introduce the opening means into the reservoir prior to being able to produce the opening, as is the case in document U.S. Pat. No. 2,659,370, for example.

In the reservoir of the invention, the means for producing the opening are preferably designed to be moved toward the inside of the container to produce the outlet opening. This facilitates the automation of the opening production, for example, by the dialysis machine.

The stopper is preferably provided with a first cylindrical wall, a radial or oblique lower wall and a radial or oblique upper wall, the lower wall and the upper wall being capable of closing the cylindrical wall so as to form the reservoir in the space comprised within the cylindrical wall and between these two walls, the outlet opening being provided in the lower wall or at the junction between the lower wall and the first cylindrical wall. The first cylindrical can be provided with sealing means to ensure sealing between the stopper and the opening of the container to be closed, these sealing means being constituted by the material used for the first cylindrical wall and/or by an annular seal.

To prevent accidental opening of the reservoir, it is preferable to provide the stopper with blocking means to prevent the opening means from being actuated, these blocking means being capable of being removed or displaced so as to render them ineffective. It is also possible to provide the stopper, in its upper portion, with means for limiting its penetration into the opening to be closed to a predetermined depth, these means being preferably constituted by a radial rim whose dimensions are greater than those of the opening to be closed. Anti-extraction means can be provided to prevent extraction of the opening means from the stopper.

In a first embodiment of the stopper, the stopper is constituted by a housing and a piston. The housing is constituted by a first cylindrical wall closed in the area of its lower edge by a radial or oblique wall, called lower wall. The lower wall has a weakness zone in the vicinity of its junction with the first cylindrical wall. The first cylindrical wall is provided at its upper edge with a radial rim oriented toward the outside, whose dimensions are greater than the dimensions of the opening to be closed. The piston is constituted by a second cylindrical wall closed in the area of its upper edge by a radial or oblique wall, called upper wall. The lower edge of the second cylindrical wall is beveled and inclined so that the height of the second cylindrical wall varies between a maximum height and a minimum height. A detachable safety tab is fixed to the periphery of the upper wall and surrounds the second cylindrical wall. The second cylindrical wall is dimensioned so as to be able to penetrate into the first cylindrical wall of the housing and the safety tab is dimensioned so as to bear against the edge of the housing when the piston is introduced into the housing so as to form the reservoir. The maximum height of the second cylindrical wall and the height of the safety tab are selected such that the difference between these two heights is less than the height of the first cylindrical wall measured between the lower wall and the rim, while the height of the first cylindrical wall measured between the lower wall and the rim is comprised between the minimum height and the maximum height of the second cylindrical wall. In this first embodiment, the piston, with its inclined and beveled edge, comes to perforate and tear the lower wall of the housing when the safety tab is torn off and the piston is pushed down into the housing, thereby producing an outlet opening.

To facilitate tearing of the lower wall, the lower wall has a weakness zone whose contours are identical to the transverse cross section of the second cylindrical wall.

In a second embodiment, the stopper comprises a housing that can be closed by a lid and a rod. The housing is made in one piece of a first cylindrical wall and a radial or oblique lower wall, called lower wall, in which is formed an opening surrounded by a sleeve that extends on the side opposite the lid. The lid consists of a radial or oblique wall, called upper wall, in which is formed a passage opening surrounded by a sleeve extending toward the lower wall. The rod is dimensioned so that its lower end can penetrate into the reservoir via the lid opening and the lid sleeve. The rod is provided in its upper portion with a first annular seal dimensioned so as to ensure sealing of the reservoir in the area of the interface between the rod and the lid sleeve. The position of the first seal is chosen so that, when said seal is located in the lid sleeve, the lower end of the rod is located within the reservoir or the housing sleeve. Recesses or a radial narrowing of the rod are provided at the lower portion of the rod, the axial height of these recesses or this narrowing being greater than the height of the housing sleeve. Blocking means are preferably provided to maintain the rod with its seal in the lid sleeve.

The housing opening or the free end of the housing sleeve is preferably closed by a membrane, and the lower end of the rod is provided with means for piercing this membrane.

In a third embodiment of the invention, corresponding to a variant of the second embodiment, the membrane is replaced by closure means present at the lower end of the rod. To this aim, the closure means are provided with a second annular seal dimensioned so as to ensure sealing of the reservoir in the area of the interface between the rod and the housing sleeve. The position of the second seal on the rod is selected so that, when the first seal is located in the lid sleeve, the second seal is located in the housing sleeve.

In these two embodiments, the outlet opening is initially closed, either by the membrane, or by the closure means present on the rod. As long as the retaining means are placed on the rod, the rod is in a position in which the reservoir is sealingly closed, on the one hand, in the area of the lid sleeve with the first seal, and on the other hand, in the area of the housing sleeve by the membrane or by the closure means of the rod. When the retaining means are removed, it is possible to push the rod down and to tear the membrane, or to remove the closure means of the rod out of the housing sleeve, thus freeing the outlet opening.

In a fourth embodiment of the invention, the stopper comprises a housing and a piston. The housing is constituted by a cylindrical wall whose lower edge is located in a radial plane while the upper edge has one or more sets of at least two steps so that the cylindrical wall has at least two different heights between the lower edge and the upper edge. A radial rim that extends outwardly is placed in the upper portion of the cylindrical wall, preferably on the step or steps corresponding to the maximum height. The piston is constituted by a radial or oblique lower wall, called lower wall, a radial or oblique upper wall, called upper wall, connected to each other by a rod, the distance between the upper face of the lower wall and the lower face of the upper wall is less than the smallest height of the cylindrical wall measured between the lower edge and the lowest step or steps. An actuation button accessible from the outside of the reservoir is provided on the upper wall. Guide elements are provided on the piston. The dimensions of said guide elements are selected so that these elements can bear on the upper edge of the cylindrical wall while being able to enter the opening of the container to be closed. The lower and upper walls are dimensioned so as to be slidable axially and pivotable in the cylindrical wall and so as to form a closed reservoir with the cylindrical wall when the piston is introduced into the housing with the lower wall located above the lower edge of the cylindrical wall and the upper wall located below the lowest step or steps.

It is preferable to provide the lower radial wall with an annular flange, called lower flange, preferably oriented downwardly, said lower flange being provided with sealing means to ensure sealing of the reservoir in the area of the lower wall/cylindrical wall interface and/or the upper wall is provided with an annular flange, called upper flange, preferably oriented upwardly, said upper flange being provided with sealing means to ensure sealing of the reservoir at the upper wall/cylindrical wall interface. The sealing means of the lower flange and/or the sealing means of the upper flange are preferably constituted by the material used for the corresponding flange and/or by an annular seal. The piston can be provided with anti-extraction means to prevent upward extraction of the piston out of the housing as soon as the reservoir has been formed, said anti-extraction means having preferably the shape of an annular shoulder arranged on the lower wall or on the lower flange. It is preferable that the cylindrical wall is provided with two identical sets of three steps having three different heights, the rim being placed in the area of the two steps corresponding to the maximum height.

The invention also relates to the use of the container in a dialysis machine provided with one or more ports dimensioned so as to receive the connecting portion or portions of the connector.

In addition, the invention relates to a method for the extemporaneous preparation of a dialysis solution in a dialysis machine provided with a container according to the invention. This method provides a step (a) of putting the container in place in the dialysis machine and introducing the connection portion or portions of the container into the corresponding ports of the machine, and a second step (b) of introducing the solution-forming liquid into the container via the introduction fluid line. The method of the invention is characterized by the following additional steps carried out prior to step a) or between step a) and step b), namely, a step (c) in which the means are actuated to open the reservoir contained in the stopper so as to produce the opening and a step (d) in which the contents of the reservoir flow into the pouch or the cartridge. Depending on the needs or the type of dialysis machine used, step c) can be performed automatically by the dialysis machine after step a), or it can be performed manually by the operator before or after step a). Most dialysis machines have a cover that comes down over the top of the connector to keep the refill in position during the dialysis. It can thus be envisioned to perform step c) during closing of this retaining cover.

The connector can be of the type described in patent application FR 11 54 323.

Figure 1:
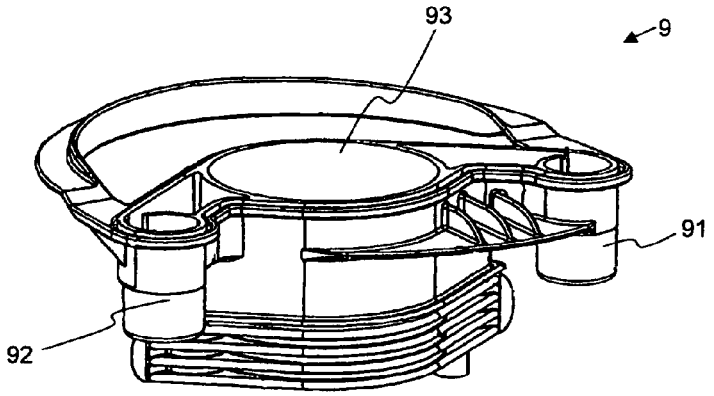

The invention is described below in more details using four exemplary embodiments shown in the following figures:

FIG. 1: Perspective view of a connector for a dialysis container;

First Embodiment

Figure 2:
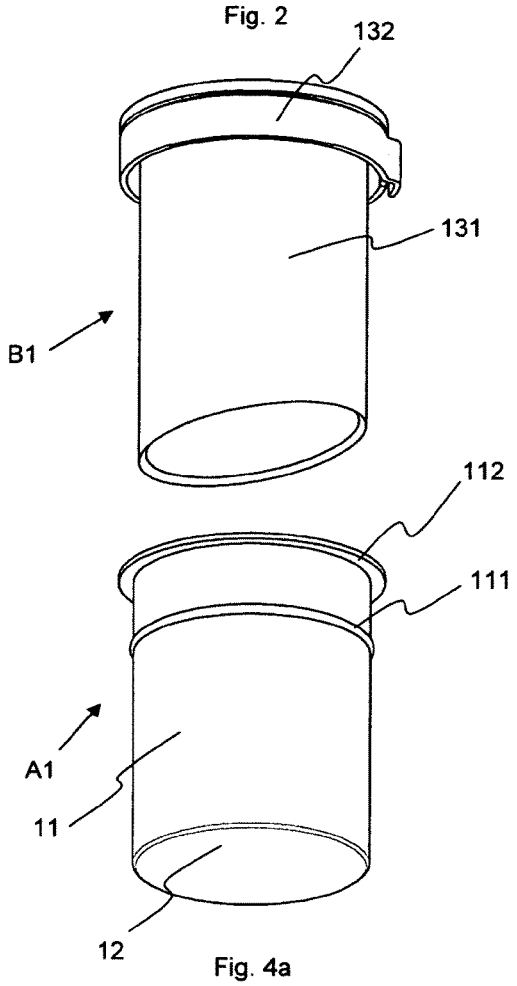
Figure 3:
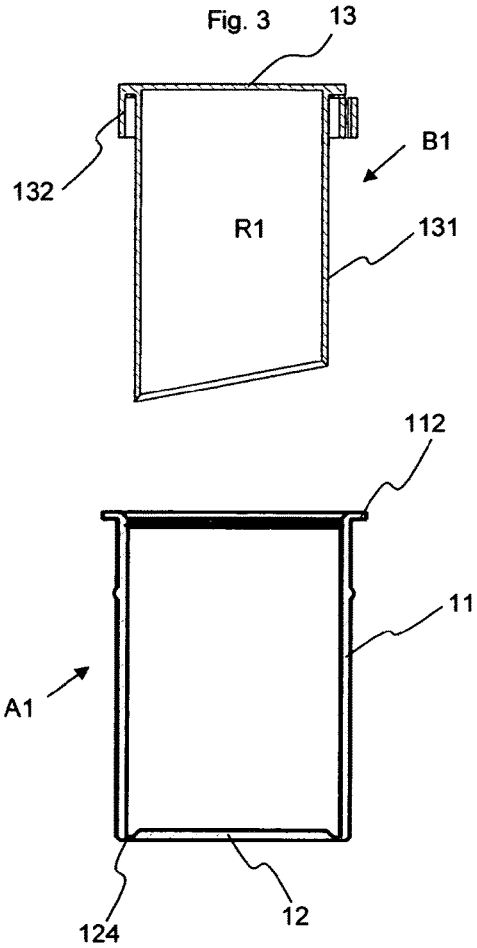
Figure 5A:
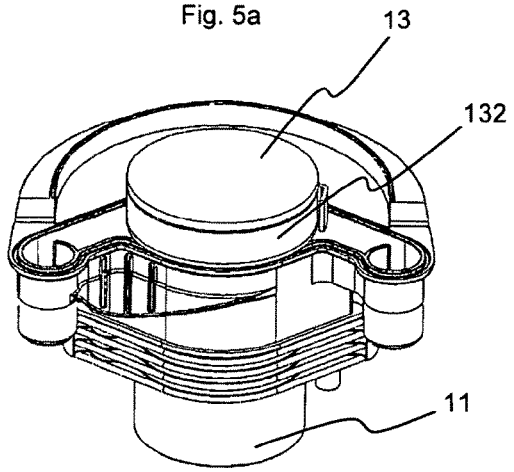

FIG. 2: Exploded perspective view of the various elements of the first stopper;

FIG. 3: Cross-sectional view of the elements of FIG. 2;

FIG. 4: Perspective view of the first stopper (a) with the piston in filling position and (b) with the stopper closed in storage configuration;

FIG. 5: Various reservoir opening stages of the first stopper placed in the filling opening of a cartridge for dialysis (a) initial position, (b) safety tab removed and (c) piston pushed down;

Second Embodiment

Figure 6:
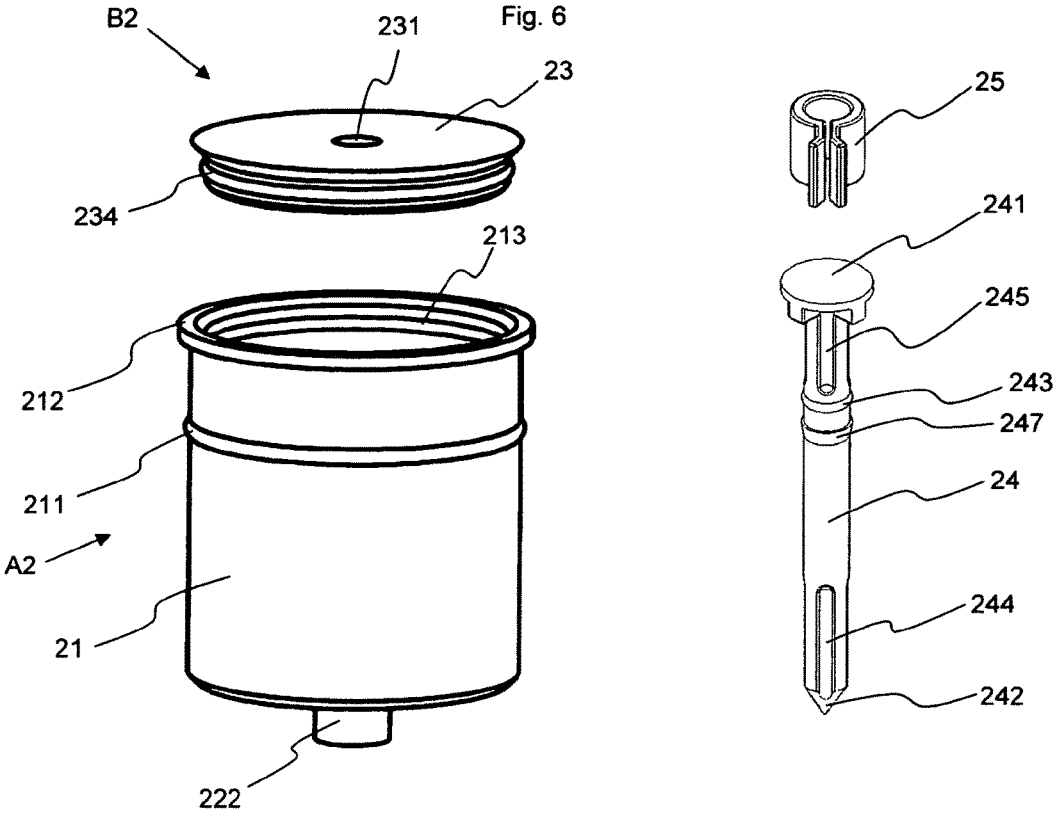
Figure 7A:
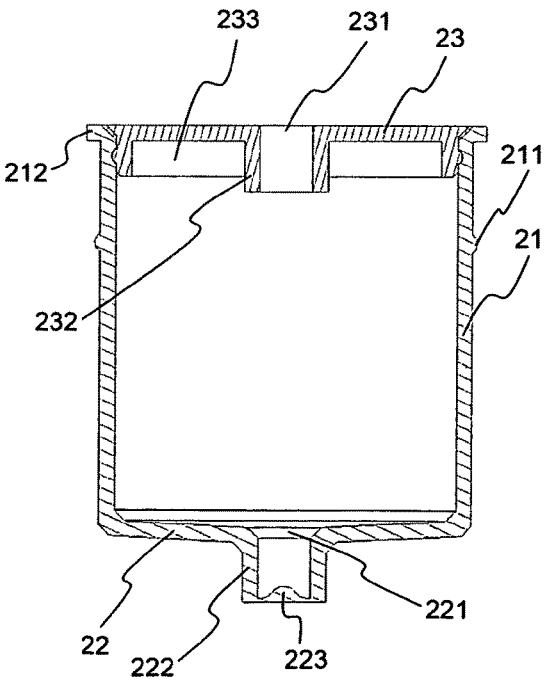
Figure 7B:
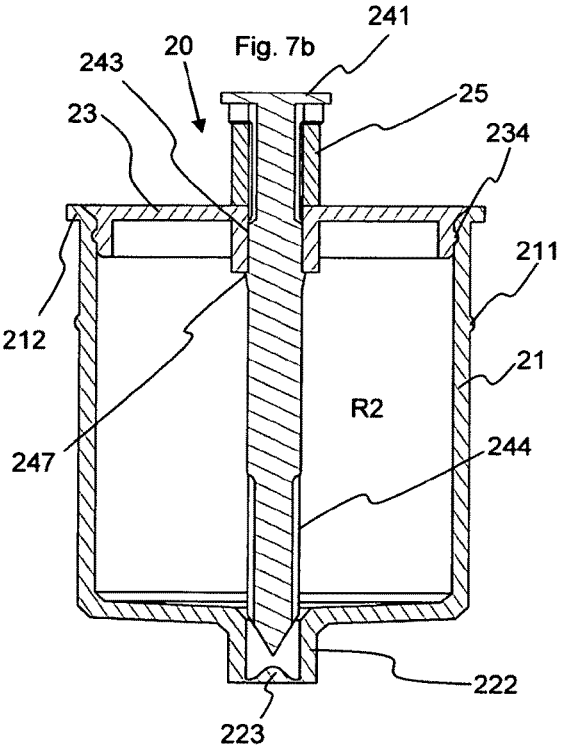
Figure 8A:
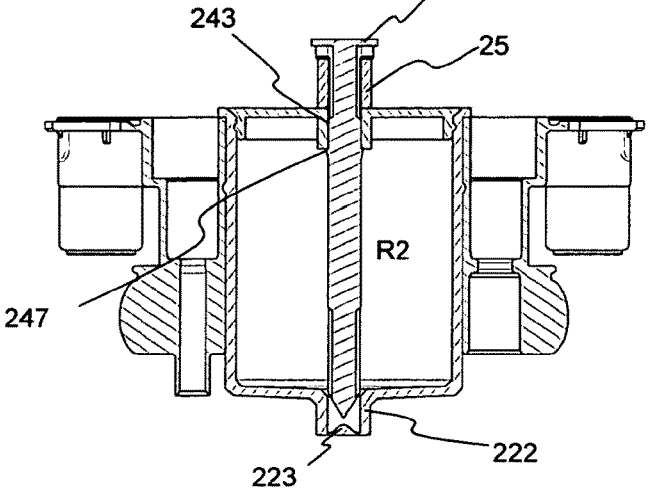
Figure 8B:
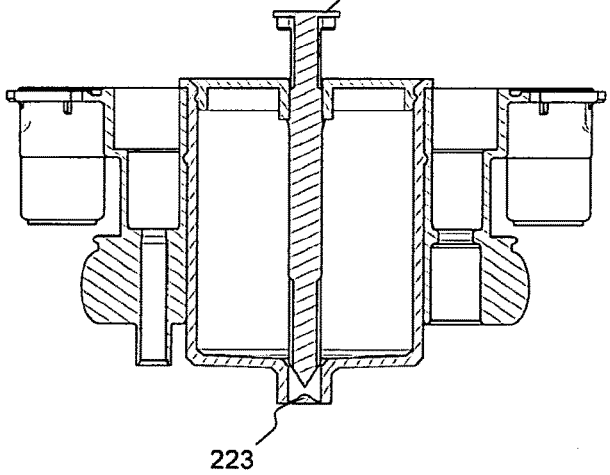

FIG. 6: Perspective view of the various elements of the second stopper;

FIG. 7: Cross-sectional view of the stopper (a) in filling position and (b) in storage configuration;

FIG. 8: Various reservoir opening stages of the second stopper placed in the filling opening of a cartridge for dialysis: (a) initial position, (b) clip removed and (c) rod pushed down;

Third Embodiment

Figure 9:
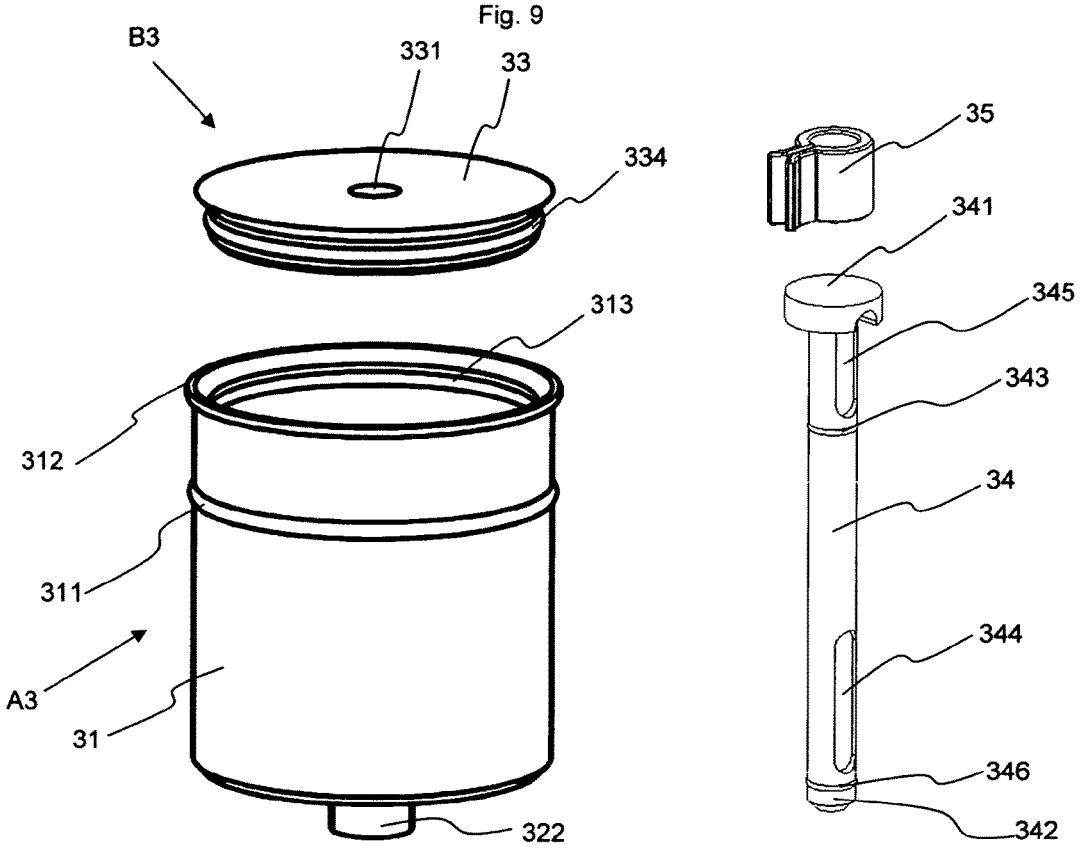
Figure 10A:
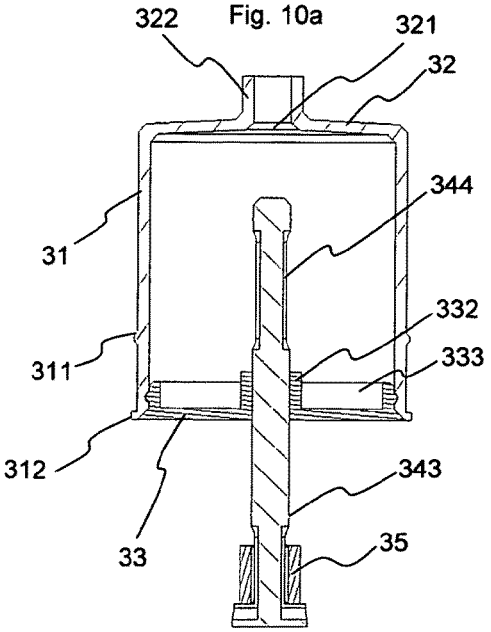
Figure 10B:
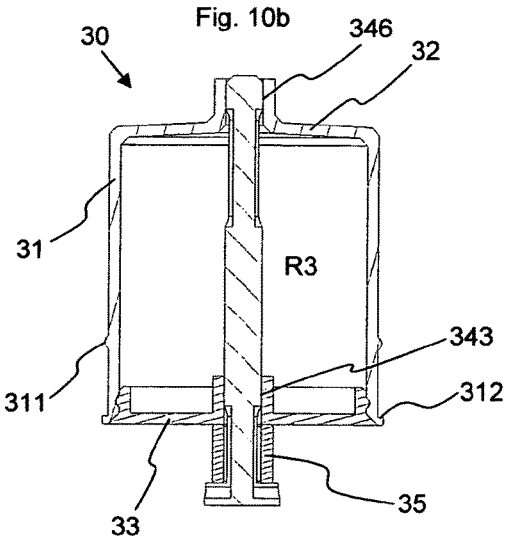
Figure 11A:
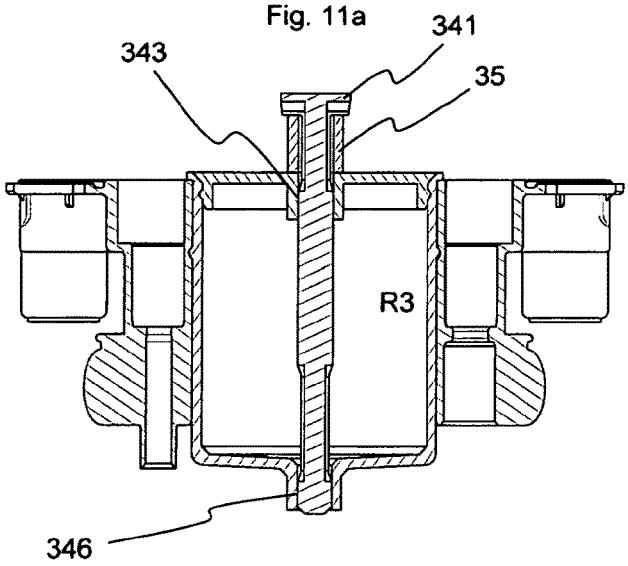
Figure 11B:
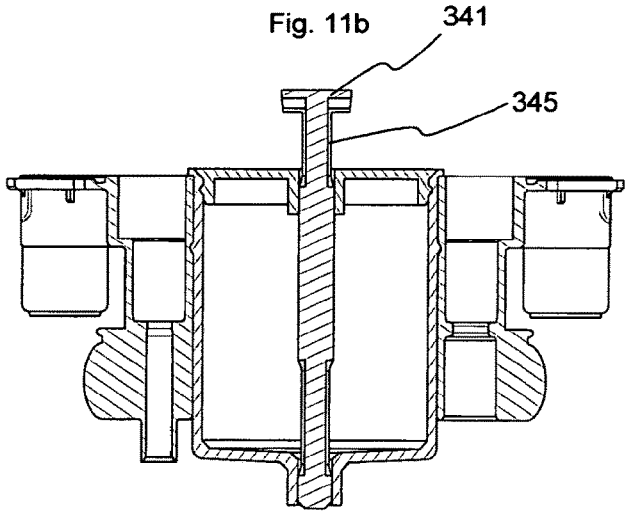

FIG. 9: Perspective view of the various elements of the third stopper;

FIG. 10: Cross-sectional view of the stopper (a) in filling position and (b) in storage conditions;

FIG. 11: Various reservoir opening stages of the third stopper placed in the filling opening of a cartridge for dialysis: (a) in initial position, (b) clip removed and (c) rod pushed down;

Fourth Embodiment

Figure 13:
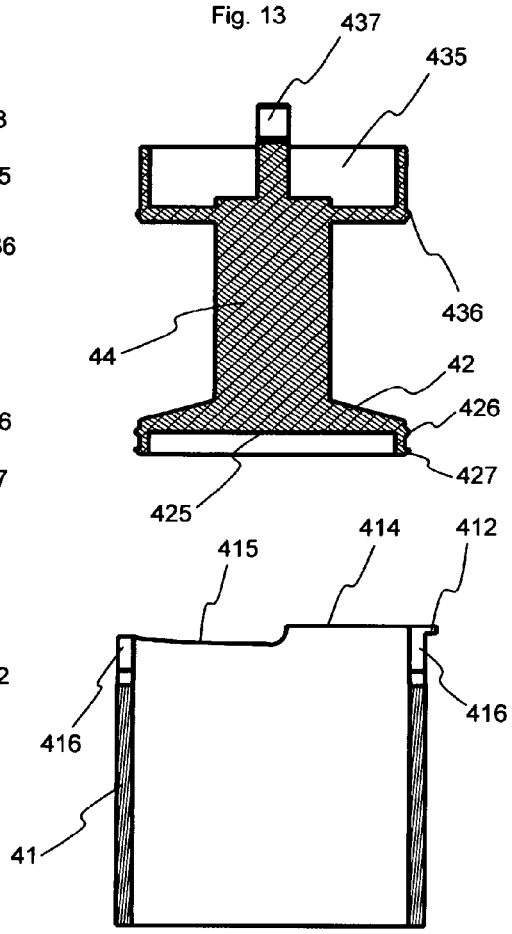

FIG. 12: Exploded perspective view of the various elements of the fourth stopper;

FIG. 13: Cross-sectional view of the elements of FIG. 12 rotated by a quarter turn;

FIG. 14: Various stages of use of the fourth stopper: (a) filling position in perspective view, (b) same position as (a) in cross-sectional view, (c) storage position in cross-sectional view and (d) opening position in cross-sectional view;

Venting Device

Figure 15A:
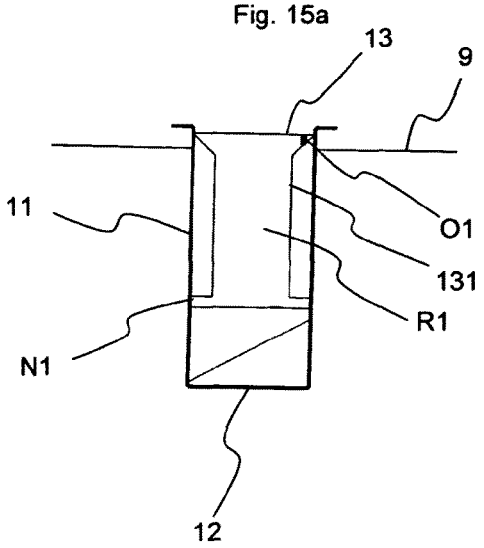
Figure 15B:
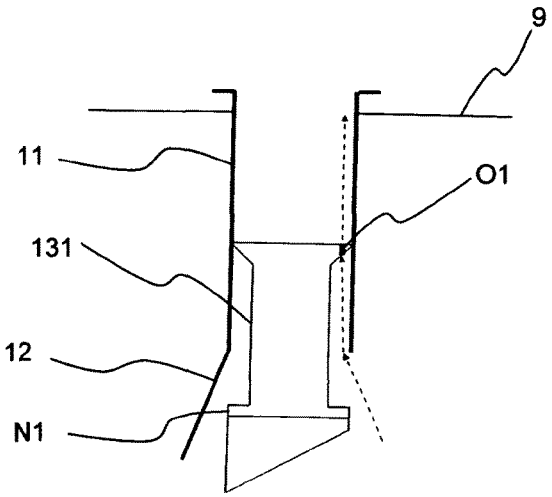

FIG. 15: Cross-sectional view of a first stopper shown schematically (a) before and (b) after actuation of the means for opening the reservoir; and FIG. 16: Cross-sectional view of a second stopper shown schematically (a) before and (b) after actuation of the means for opening the reservoir.

The description of the various parts of the stoppers of the invention uses spatial references such as "upper," "lower" or "vertical." These spatial references refer to the stopper shown in the usual position of use in a dialysis machine as shown in FIG. 5, 8 or 11, for example. In this case, the stopper is located above the container that it closes. However, these positions are not absolute, and it is possible to use the stopper of the invention in another position, especially with the stopper below the vial that it closes. For example, in FIG. 4*a* and are 10*a*, some elements of the stopper are shown upside down for filling: the "lower" wall is then above the "upper" wall. In addition, the stoppers of these exemplary embodiments have an axis of rotational symmetry corresponding to the direction of insertion of the stopper into the opening of the container that it must close. References such as "radial" or "axial" refer to this axis of symmetry. It is immediately understood that if the stopper does not have such a rotational symmetry, these references are used by analogy in relation to an imaginary line passing through the center of the transverse cross-section of the stopper and oriented in the direction of insertion of the stopper into the opening.

The invention relates to containers used as refills for dialysis. These refills are made up mainly of a pouch or a cartridge fixed on a connector (9). They generally contain a solid concentrate. Refills of the invention make it possible to use, in particular, solid concentrates containing glucose.

The connector is provided with means for introducing the solution-forming liquid to extract the obtained solution. These means comprise, in particular, a connecting portion (91) for connecting the container to a corresponding port on the dialysis machine. In the example shown in FIG. 1, the introduction and extraction means are constituted by two fluid lines, one for introducing purified water and the other for drawing the saturated solution. Each fluid line is provided at its outer end with a connecting portion (91, 92) intended to penetrate into a port of the dialysis machine. The other ends of the fluid lines open into the inside of the pouch or the cartridge. It is also possible to provide that the two fluid lines are combined into a single fluid line serving both for introducing the solution-forming liquid and for drawing the solution produced. The equivalent of the second line can be used as air intake to ensure the pressure balance if the pouch or cartridge is rigid. It is necessary to provide a central filling channel (93) in the connector for introduction of the solid product, for example, the solid concentrate containing glucose, into the container. After completion of the filling operation, the central channel (93) must be closed sealingly so that no dirt can penetrate into the container and pollute its contents. When the solution to be manufactured contains only the first product contained in the pouch or cartridge, the channel (93) can be sealed by a film. If, on the contrary, the solution must contain a second product that must be separated from the first product during storage of the product contained in the pouch or cartridge, for example, acid, the filling channel (93) can be closed by a stopper equipped with a reservoir.

The stopper (10, 20, 30, 40) is constituted by a cylindrical wall (11, 21, 31, 41) that can be closed at both ends by a lower radial wall (12, 22, 32, 42) and an upper radial wall (13, 23, 33, 43), the first (12, 22, 32, 42) being located inside the container and the second (13, 23, 33, 43) being located outside the container when the stopper is put in place in the opening of the container, as shown for example in FIGS. 5, 8 and 11. The area delimited by the cylindrical wall (11, 21, 31, 41) and the two radial walls (12, 13, 22, 23, 32, 33, 42, 43) forms a closed reservoir (R1, R2, R3, R4). Means are provided in the stopper to produce an outlet opening that contacts the inside the reservoir with the side of the stopper located in the container when the stopper is put in place in the opening of a container, these opening means being operable from outside the container.

The cylindrical wall (11, 21, 31, 41) is intended to penetrate at least in large part into the opening (93) of the container so as to close it sealingly. Once in place, the cylindrical wall cannot move with respect to the closed opening.

To ensure sealing, the cylindrical wall (11, 21, 31, 41) can be made in a rubber-type material so that it exactly matches the contours of the wall of the opening to ensure sealing directly. It is also possible that the transverse cross-section of the cylindrical wall (11, 21, 31) of the stopper is slightly less than the transverse cross-section of the opening to be closed. In this case, the stopper can be provided with an annular seal (111, 211, 311) that comes to bear against the wall of the opening (93).

To limit the penetration of the stopper into the opening to be closed (93), the upper edge of the cylindrical wall (11, 21, 31, 41) is provided with an outwardly oriented radial rim (112, 212, 312, 412) whose dimensions are greater than the transverse cross-section of the opening to be closed (93).

In a first embodiment of the invention, the stopper (10) is constituted by a housing (A1) and a piston (B1). The housing (A1) is constituted in one piece by the cylindrical wall (11) and the lower radial wall (12). The thickness of the lower radial wall (12) is less important at its periphery than in the rest of the wall, so that this reduction constitutes a weakness zone (124) at the junction between the cylindrical wall and the lower radial wall.

The piston (B1) is constituted, on the one hand, by a radial wall constituting the upper radial wall (13), and on the other hand, by a second cylindrical wall (131). The edge of the free end of the second cylindrical wall (131), which is the end opposed to the upper radial wall, is preferably inclined, that is to say, it is longer on one side than on the other. In other words, the height of the second cylindrical wall varies between a maximum height and minimum height. In addition, this edge is preferably beveled so as to form a sort of cutting blade. This second cylindrical wall (131) is intended to penetrate into the first (11) when the stopper is assembled. It is dimensioned so that its beveled edge faces the weakness zone (124) of the lower radial wall of the housing. The upper radial wall (13) of the piston is wider than the cylindrical wall (11) of the housing.

A detachable safety tab (132) is fixed to the periphery of the radial wall (13). It is constituted by a cylindrical wall extending in the same direction as the second cylindrical wall (131) and on the same side of the upper radial wall (13). Its free end, which is the end opposed to the upper radial wall, is dimensioned so as to bear against the rim (112) of the cylindrical wall (11) of the housing when the stopper is assembled. This safety tab (132) extends preferably completely around the radial wall (13). It can be torn off, which then makes it possible to press the piston (B1) down into the housing (A1). The height of the second cylindrical wall (131) and the height of the safety tab (132) are selected so that, when the safety tab (132) bears against the rim (112), the free end of the second cylindrical wall (131) is located in the vicinity of the lower radial wall (12) without touching it, in alignment with the weakness zone (124). Conversely, when the security tab (132) is torn off and the piston (B1) is fully pushed down in the housing (A1), the lower end of the second cylindrical wall tears the zone of weakness (124) over all or part of its length and protrudes at least partly out of the housing (A1). The piston stroke is limited by the radial wall (13) coming into abutment against the rim (112). Therefore, the maximum height of the second cylindrical wall (131) and the height of the safety tab (132) are selected so that the difference between these two heights is less than the height of the first cylindrical wall (11) measured between the lower radial wall (12) and the rim (112), while the height of the first cylindrical wall (11) measured between the lower radial wall (12) and the rim (112) is less than the maximum height the second cylindrical wall.

The lower radial wall (12) constitutes means for closing the reservoir (R1). The piston (B1) with the inclined and beveled edge of the second cylindrical wall performs the function of opening means. The slot that appears between the lower end of the cylindrical wall (11) and the edge of the lower radial wall (12) in the area where the weakness zone (124) is torn constitutes an output opening (128) for the product contained in the reservoir (R1). The safety tab (132) acts as blocking means.

Figure 4A:
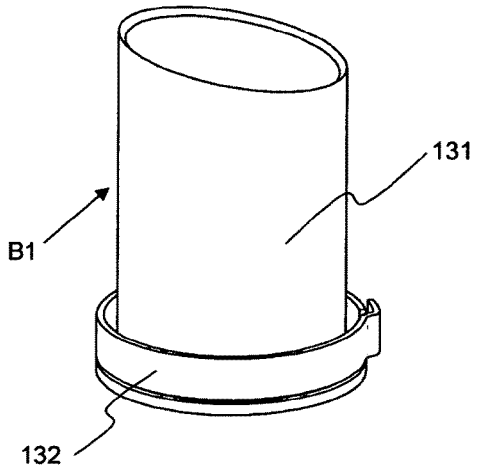
Figure 4B:
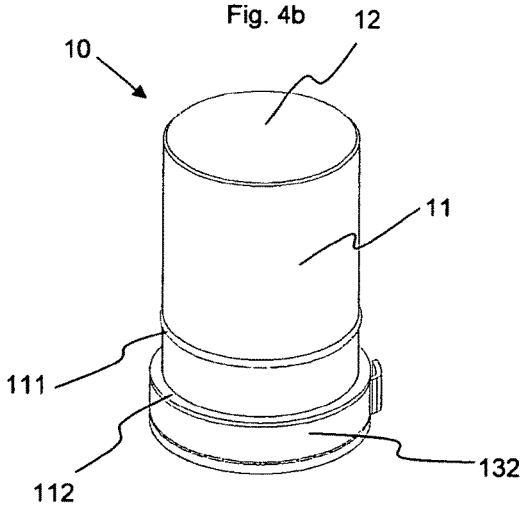

To fill the stopper (10), it is necessary, as shown in FIG. 4*a*, to first turn the piston (B1) over, and to place the liquid or solid in the cup formed by the second cylindrical wall (131) and the radial wall (13). The housing (A1) is then slipped over the piston. The first cylindrical wall (11) of the housing comes to surround the second cylindrical wall (131) of the piston. The rim (112) of the housing comes to abut against the free end of the safety tab (132). Latching means that are not shown prevent the piston (B1) from coming out of the housing (A1). These latching means not shown serve as anti-extraction means. The stopper (10) thus assembled and filled is shown in FIG. 4*b*. It is in the storage configuration in which it can be stored separately or introduced into an opening (93) until the time of forming the solution.

Figure 5B:
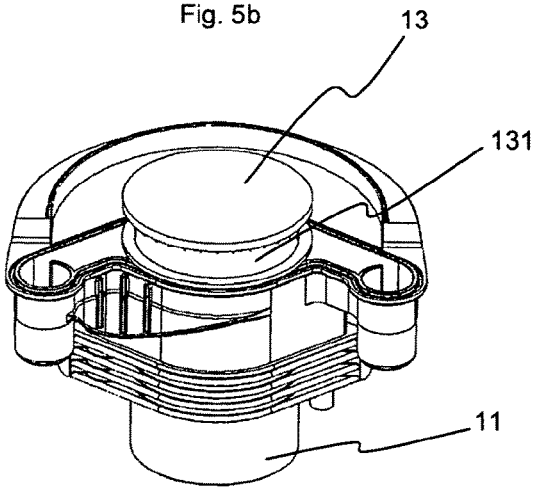
Figure 5C:
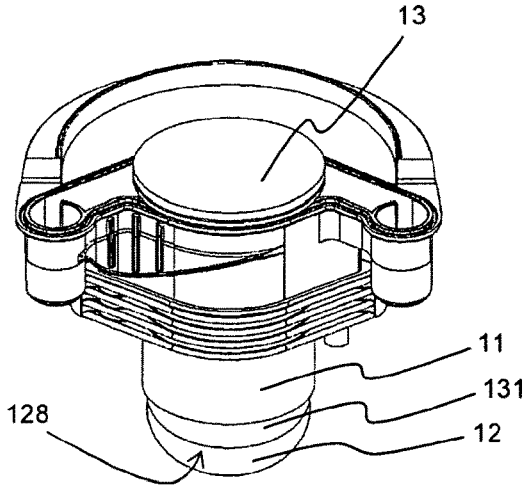

The stopper (10) filled with a first product, for example, acid, is placed in the opening (93) of the container after filling thereof with the second product, a solid concentrate containing glucose, for example. This is the situation shown in FIG. 5*a*. At the time of use, the operator removes the security tab (132) and places the cartridge in the dialysis machine (FIG. 5*b*). The piston is then pushed, either manually or by the dialysis machine. The inclined and beveled edge of the second cylindrical wall (131) comes in contact, in the area of the maximum height, with a point of the weakness zone (124) of the lower radial wall (12). The further descent of the piston causes perforation of the weakness zone at the first contact point then tearing of the weakness zone along with the penetration of the piston. Depending on the height of the second cylindrical wall (131) at its shortest point compared to the height of the cylindrical wall (11) of the housing, the lower radial wall (12) remains attached by a portion of its weakness zone to the cylindrical wall (11), as shown in FIG. 5*c*, or is completely torn and falls into the container.

In a second embodiment, the stopper (20) comprises a housing (A2), a lid (B2), a rod (24) and a clip (25). The housing (A2) is constituted in one piece by the cylindrical wall (21) and the lower radial wall (22). An opening (221), called lower wall opening, is provided in the lower radial wall (22), preferably in the center thereof. This opening (221) is surrounded by a cylindrical sleeve (222) oriented downwardly, that is to say, away from the cylindrical wall (21). An annular radial edge (212) oriented outwardly is placed in the upper portion of the cylindrical wall, preferably in the area of its upper edge. An annular groove (213) is formed on the inner face of the cylindrical wall (21), in the vicinity of the rim (212). The upper end of the inner face of the cylindrical wall (21) preferably has the form of a truncated cone that widens in a direction away from the lower radial wall (22).

The lid (B2) is essentially constituted by a planar radial wall (23), called upper radial wall, which has the form of a disc. The lid is crossed in its middle by an opening (231), called lid opening. A sleeve (232) surrounding this opening (231) is provided on the lower face of the radial wall (23), that is to say, the face oriented toward the inside of the reservoir (R2) when the lid (B2) is placed on the housing (A2). On this same lower face, a cylindrical flange (233) concentric with the sleeve (232) was placed on the circumference of the disc (23)). On the outer face of this flange is located an annular rib (234). The peripheral edge of the radial wall (23) has a frustoconical shape that widens in a direction toward the outer face of the disc (23).

The dimensions of the lid (B2) are chosen so that its flange (233) comes to be embedded in the upper end of the housing (A2). The rib (234) of the lid enters the annular groove (213) of the housing so that the lid is retained in the housing. The frustoconical edge of the lid comes into contact with the frustoconical edge of the cylindrical portion (21), these two frustoconical surfaces having complementary shapes. The opening (231) of the lid and the opening (221) of the housing are aligned. The sleeve (232) of the lid and the sleeve (222) of the housing are coaxial. Sealing of the lid in the area of the lid/housing interface is ensured by the contact between the two frustoconical surfaces and/or by the embedding of the rib (234) of the lid in the groove (213) of the housing.

A membrane (223) closes the sleeve (222) that surrounds the opening (221) of the housing (A2). This membrane performs the function of means for closing the outlet opening.

The opening means of the reservoir (R2) comprise a mobile rod (24) intended for tearing the membrane (223) that closes the reservoir at the time of use. The rod is received in the stopper (20) by passing through the sleeve (232) of the lid. Its lower end (242) penetrates partly into the sleeve (222) of the housing. The rod is surmounted by a knob (241).

Once introduced into the stopper, the rod can take two main positions. In the first position, called high position or closed position, shown in FIGS. 7*b* and 8*a*, its lower end (242) is located inside the sleeve (222) of the housing in the vicinity of the membrane (223) but without touching it. The upper portion of the rod with the knob (241) is located outside the stopper, above the upper radial wall (23). The rod (24) is held in this position by a removable clip (25) placed around the rod between the knob (241) and the upper radial wall (23). This clip (25) serves as blocking means.

Figure 8C:
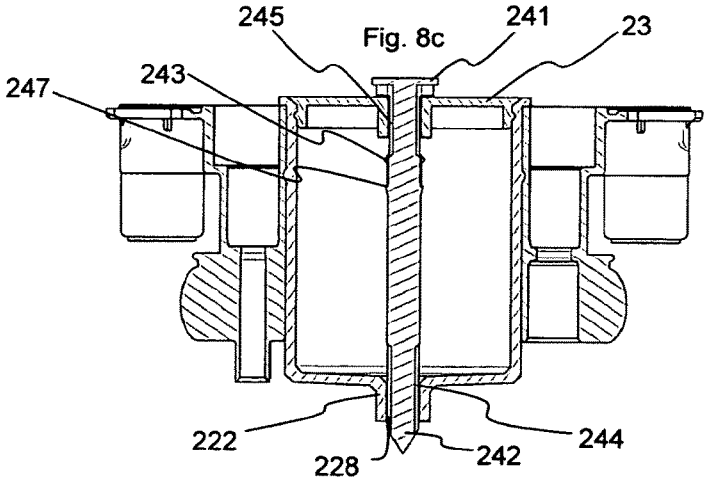

When the clip (25) is removed, it is possible to push the rod further down into the stopper until it reaches a second position, called low position or open position, shown in FIG. 8*c*. In this low position, the lower face of the knob (241) is in abutment against the radial wall (23) of the lid while the lower end (242) protrudes out of the sleeve (222) of the housing (A2) after tearing the membrane (223). In this low position, only the button (241) protrudes out of the stopper on the upper side. The length of the rod is therefore greater than the distance between the outer face of the upper radial wall (23) and the lower end of the sleeve (222) of the housing, when the lid is placed on the housing.

In order to ensure sealing of the reservoir (R2) in the area of the rod (24), the rod is provided with a first annular seal (243). This seal is arranged so that, when the rod is in the high position, the seal (243) is located inside the sleeve (232) of the lid (23), bearing against it. In the low position of the rod, this seal (243) is located outside the sleeve (232) of the lid, below it. If sealing must be maintained in the area of the stopper so as to avoid, in particular, entry of contaminated air into the container, it is possible to place the seal (243) so that, even in the low position of the rod, it remains in the sleeve (232).

To prevent the rod from being removed from the stopper, thus providing access to the inside of the reservoir, an annular retaining shoulder (247) is provided on the rod, below the seal (243). This shoulder is intended to be placed below the sleeve (232) of the lid (B2) once the rod (24) has been inserted into the stopper in the high position after filling. The cross-section in the radial (horizontal) plane of this shoulder is greater than that of the lid sleeve. The shoulder has a triangular transverse cross-section in an axial (vertical) plane, its lower face, oriented toward the free end (242) of the rod, being inclined upwardly and away from the rod while its upper face is in the radial (horizontal) plane or slightly inclined upwardly and away from the rod. The distance between the upper face of the retaining shoulder (247) and the lower face of the knob (241) is equal to or slightly greater than the distance defined by the height of the clip (25) and that of the sleeve (232). Thanks to its inclined lower face, the shoulder does not impede the introduction of the rod into the stopper, however, its radial or also slightly upwardly inclined upper face prevents upward extraction of the rod, by coming in abutment against the lower end of the sleeve (232). The retaining shoulder (247) performs the role of anti-extraction means.

When the rod (24) is in the high position, the reservoir (R2) is sealingly closed in the area of the sleeve (222) of the housing, thanks to the membrane (223), and in the area of the sleeve (232) of the lid, thanks to the seal (243).

To allow the contents of the reservoir (R2) to flow out of the stopper, it is provided to form at least one axial recess (244) in the area of the lower end (242) of the rod. This or these recesses (244) are longer than the height of the sleeve (222) of the housing (A2) so that in the low position of the rod, they project above and below the sleeve (222). The upper portions of these recesses stop below and at a distance from the seal (243).

It would also be possible to replace the recess or recesses (244) by a general narrowing of the section of the rod in the same area as the recesses (244) thus replaced. This narrowing must also be longer than the height of the sleeve (222) so that, in the low position of the rod, it extends above and below this sleeve (222). The upper portion of this narrowing stops below and at a distance of the seal (243).

Thus, to release the contents of the reservoir (R2), the clip (25) must be removed, then pressure must be applied on the knob (241) of the rod toward the lower radial wall (22). The lower end of the rod tears off the membrane (223) and protrudes out of the sleeve (222) so that the recesses (244) or the narrowing are placed in the sleeve, thereby providing one or more outlet openings (228) for the product contained in the reservoir (R2).

Although it is not imperative to maintain sealing of the stopper in the area of the rod while the reservoir is opened, it can be useful to provide one or more axial recesses (245) in the upper part of the rod, between the knob (241) and the seal (243), to allow air to enter the reservoir (R2) when the rod is in the low position. These axial recesses extend up to within the knob (241).

To fill the stopper (20), the lid (B2) must be placed on the housing (A2), then the product must be introduced into the reservoir (R2) via the sleeve (232) of the lid. This is the situation shown in FIG. 7*a*. The rod (24), provided with the clip (25), is then introduced into the reservoir via the opening (231) and the sleeve (232) of the lid, until its lower end (242) enters the sleeve (222) of the housing and the anti-extraction shoulder has come out of the sleeve (232). The penetration of the rod (24) into the stopper is limited by the clip (25) coming in contact with the outer face of the upper radial wall (23) that forms the lid. It would also be possible to fill the housing first, and then arrange the lid and the rod.

A third embodiment is a variant of the previous example. The stopper (30) is constituted by a housing (A3), a lid (B3) and a rod (34) retained by a removable clip (35). All these parts have substantially the same characteristics as the corresponding parts of the stopper (20). The difference resides in the fact that the lower end (342) of the rod (34) is provided with means for closing the opening (321) and the sleeve (322) of the housing (A3) instead of the membrane (223). To this effect, the rod (34) carries two seals (343, 346). The first seal (343) is used, as in the example of the stopper (20), to ensure sealing of the reservoir in the area of the sleeve (332) that surrounds the opening (331) of the lid when the rod is in the high position. The second seal (346) ensure sealing of the reservoir in the area of the sleeve (322) that surrounds the opening (321) of the housing (A3). It is placed below the axial recess or recesses (344) that serve for discharging the product when the reservoir is open, so that, in the high position of the rod, the second seal bears against the inner wall of the housing sleeve (322), while in the low position of the rod, this seal is located outside the sleeve (322), the recess or recesses (344) opening at their lower ends out of the reservoir, below the sleeve (322), and at their upper ends into the reservoir, above said sleeve (322), thus providing one or more outlet openings (328).

As for the stopper (20), the rod could have a narrowing of its transverse cross-section instead of the recess or recesses (344). The second seal (346) must be placed below the narrowing.

To fill the stopper (30), it is necessary to form the reservoir by assembling the housing (A3) and the lid (B3), to introduce the rod into the opening (331) of the upper radial wall (33) so that its free end is located inside the reservoir (R3), but at a distance from the opening (321) of the lower radial wall (32). The stopper with the partially introduced rod is then turned over so that the sleeve (322) of the housing (A3) is located at the top. This corresponds to the position shown in FIG. 10*a*. The radial (horizontal) cross-section of the rod (34) between the first seal (343) and the axial recesses (344) or the narrowing is identical or only slightly less than the radial (horizontal) cross-section of the sleeve (332) of the lid (B3). Thus, the opening (331) of the lid (B3) is closed by the rod and the product cannot escape through this opening (331). When filling is completed, the rod with the clip (35) is completely pushed down into the stopper (30) until the clip comes in abutment against the lid (B3). In this position, called high position or closed position, shown in FIG. 10*b*, the lower end (342) of the rod provided with the second seal (346) is located in the sleeve (322) of the housing while the first seal (343) is located in the sleeve (332) of the lid (B3), so that the two sleeves are closed in a sealed manner. The rod is dimensioned so that the end face at the lower end of the rod is approximately aligned with the free end of the sleeve (332) of the housing when the rod is in the high position.

Figure 11C:
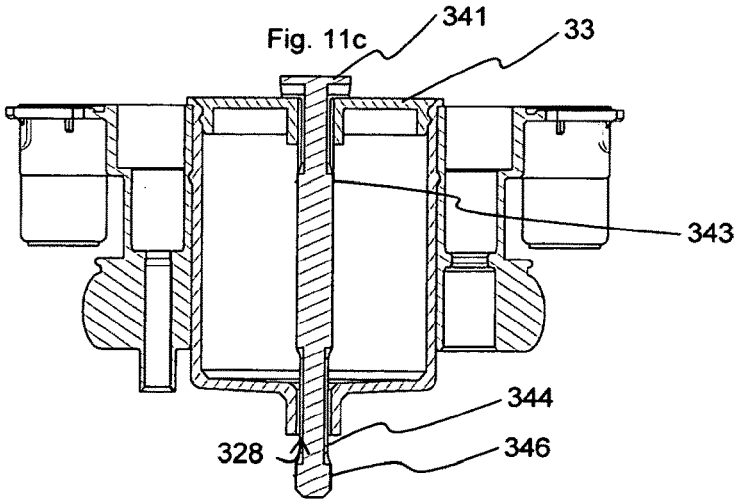

To release the product contained in the reservoir (R3), the clip (35) (see FIG. 11*b*) must be removed, as for the stopper (20), and the knob (341) of the rod must be pushed down toward the lower radial wall (32) until the lower side of the knob (341) comes to abut against the outer face of the upper radial wall (33) (see FIG. 11*c*). As for the stopper (20), the rod can be provided with one or more axial recesses (345) between the knob (341) and the first seal to allow air to enter the reservoir (R3) when the outlet opening (321) is open.

In a fourth embodiment, the stopper (40) is constituted by a housing (A4) and a piston (B4). The housing (A4) is constituted essentially by the cylindrical wall (41) and the rim (412). The lower edge of the cylindrical wall is located in a radial plane. The upper edge of the cylindrical wall (41) has two identical and symmetrical sets of three steps. To this effect, it is divided into two identical and symmetrical sections. Each section is divided into three sectors in which the cylindrical wall has, in each case, a different height. In the first sectors (414), the cylindrical wall has its maximum height. The rim (412) is fixed to the edge of the cylindrical wall in the area of these two sectors (414). The rim extends radially and outwardly from the cylindrical wall. In the second sectors (415), the cylindrical wall has a slightly smaller height forming a second step. In the third areas, located between the first and second sectors, the third step is constituted by the bottom of a notch (416). This third step is even lower that the second formed by the edge of the cylindrical wall in the area of the second sectors (414). The angular dimension of the first and second sectors is substantially identical, while that of the third sector is preferably significantly smaller.

The piston (B4) is constituted by a first radial wall, called lower radial wall (42), and a second radial wall, called upper wall radial (43), the two radial walls (42, 43) being connected to each other by a connecting rod (44), reinforced by four vertical fins in the present example. The lower radial wall (42) is extended at its periphery by a flange (425) directed downwards, while the upper radial wall (43) is extended at its periphery by a flange (435) directed upwards. The diameter of the radial walls (42, 43) and their flanges (425, 435) corresponds substantially to the inside diameter of the cylindrical wall (41). If the materials used allow it, the dimensions of the radial walls and the flanges are chosen so that they are pressed against the inner face of the cylindrical wall and ensure sealing directly. It is also possible, as provided in this example, that the diameter of the radial walls plus their flanges is slightly less than the inside diameter of the cylindrical wall. In this case, each of the flanges can be provided with an annular seal (426, 436) which is pressed against the inner face of the cylindrical wall (41) and thus ensures sealing.

In addition, the piston (B4) is provided with an actuation knob (437) with which it is possible to rotate the piston (B4) within the housing (A4). This actuation knob (437) is constituted by a vertical plate fixed to the upper face of the upper radial wall (43) and the inner face of the corresponding flange (435). The height of the plate is greater than that of the flange, so that it protrudes vertically above it. In its portion located above or in the area of the flange, the plate extends radially beyond the flange, so as to form two guide elements (438). The dimensions of these guide elements are selected so that said guide elements can be supported on the upper edge (414, 415, 416) of the cylindrical wall (41) while being able to enter the opening (93) of the container to be closed. In practice, the length of the plate forming the knob in the area of the guide elements is between the inner diameter of the cylindrical wall and the diameter of the opening to be closed (93). It is actually preferable that this length be less than the outer diameter of the cylindrical wall so that the guide elements (438) do not protrude from the envelope of the stopper defined by the outer face of the cylindrical wall.

Figure 14A:
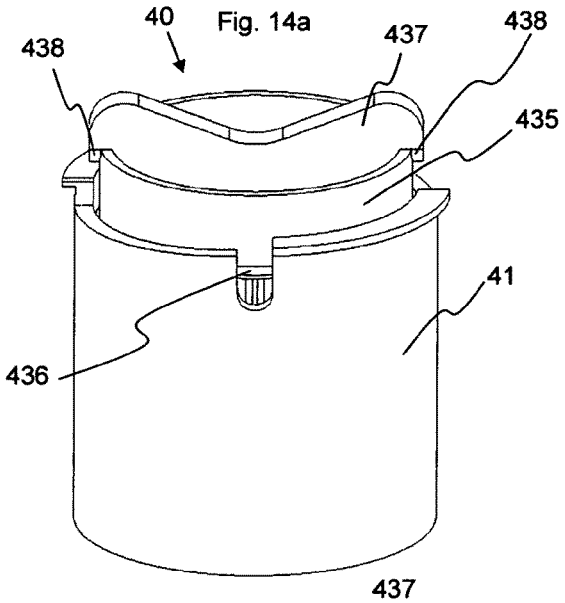
Figure 14B:
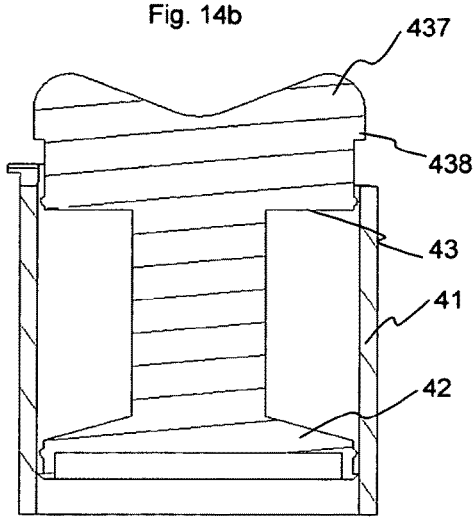
Figure 14C:
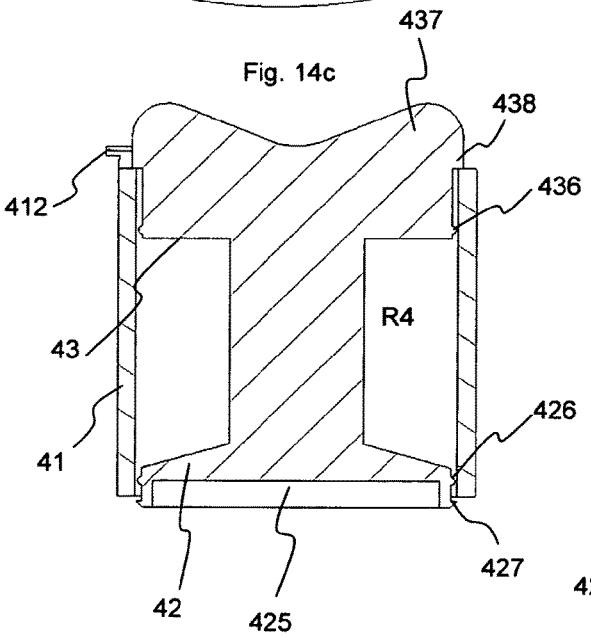
Figure 14D:
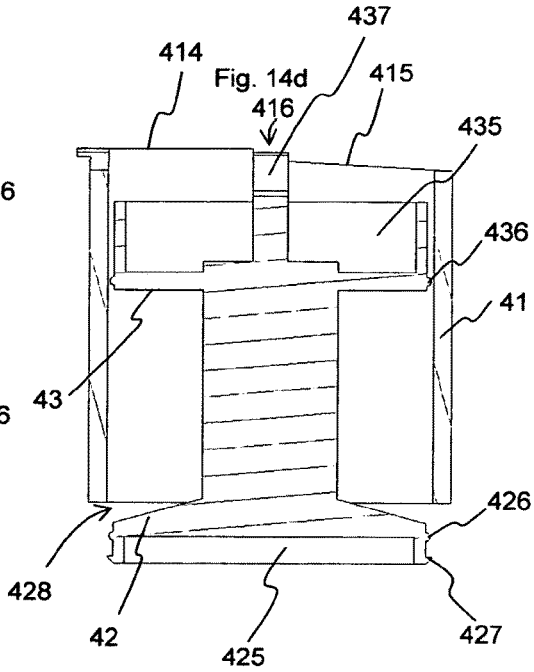

The piston (B4) can take three distinct positions inside the housing (A4). In a first position, called filling position, the piston is placed inside the housing with the lower radial wall (42) and its flange (425) located inside the cylindrical wall at a distance from the lower edge, the upper radial wall (43) being placed inside the cylindrical wall at about mid-height of the notches (416) and the guide elements (438) being supported on the rims (412) or being above these rims (412). In this position, the reservoir (R4) is not fully closed, because the upper radial wall is located above the bottom of the notches (416), thus leaving access to the reservoir as shown in FIG. 14*a*. It is therefore possible to fill the reservoir (R4).

After filling, the piston (B4) is rotated so that the guide elements (438) are located above the second sectors (415). As soon as the guide elements (438) have left the rims (412) located in the first sectors, it is possible to push the piston down until the guiding means come to abut against the edge of the cylindrical wall in the second sectors (415), that is to say, on the second step. In this second position, called storage position, shown in FIG. 14*b*, the lower radial wall (42) and its flange (425) are located in the area of the lower edge of the cylindrical wall (41) and the upper radial wall (43) is located within the cylindrical wall, below the notches (416). More specifically, the annular seal (426) located on the flange (425) of the lower radial wall (42) is located in the vicinity of, and slightly above, the lower edge of the cylindrical wall. Similarly, the annular seal (436) located on the flange (435) of the upper radial wall (42) is located in the vicinity of, and below, the bottom of the notches (416). In the storage position, the reservoir (R4) is sealed by two annular seals (426, 436), which are pressed against the inner face of the housing (A4).

To prevent the piston (B4) from being removed from the housing (A4), it is preferable to provide a retaining shoulder (427) on the flange (425) of the lower radial wall. In the storage position, this shoulder is located outside the housing (A4). It is thus impossible to move the piston from the storage position to the filling position, because the shoulder (427) comes to abut against the lower edge of the housing (A4) and prevents the upward movement of the piston. Similarly, it is impossible to empty the reservoir by mistake, because the guide elements abut against the second steps, thus preventing a downward displacement of the piston.

To empty the reservoir (R4), it is necessary to again rotate the piston (B4) so as to align the guide elements (438) with the notches (416) and then push the piston down so that the guide elements enter these notches. In this position, the lower radial wall and its flange are located outside the housing, below its lower edge, while the upper radial wall is located inside the housing (A4). The product contained in the reservoir can flow through the annular slot (428) formed between the lower edge of the housing and the upper face of the lower radial wall. To facilitate the flow of the product, it is preferable that the upper face of the lower radial wall (42) is slightly convex, dome-shaped, or conical.

In this fourth embodiment, the lower radial wall performs the function of means for closing the outlet opening (428) and thus the reservoir, and the rod (44) associated with the knob (437) forms the opening means. The slot formed between the lower edge of the cylindrical wall (41) and the lower radial wall (42) constitutes the outlet opening. The pressure exerted on the knob (437) can be applied manually by the operator or automatically by the dialysis machine.

In the embodiments shown in the figures, the stopper and its component parts have, except for a few details, a rotational symmetry around an axis parallel to the direction of insertion into the opening that it is intended to close. In other words, their radial (horizontal) sections, that is to say, perpendicular to the direction of insertion, have substantially the shape of a circle. Yet it would of course be possible to give another shape adapted to the opening to be closed (93) at least to the cylindrical portion (11) and the radial walls (12, 13), for example a transverse cross-section that is elliptical, triangular, rectangular, etc. In the case of the fourth embodiment, the transverse cross-section of the outer face of the cylindrical wall is not necessarily round.

The upper and lower radial faces are not necessarily flat and may deviate from a plane strictly perpendicular to the insertion axis. In particular, it can be seen with the example of the fourth stopper (40) that the lower radial wall is slightly conical. Thus, the term radial must not be taken literally, that is to say, perpendicular, but in the more general sense, that is to say, the walls considered can be simply oblique with respect to the cylindrical wall.

The stopper is used as follows.

In a first stage, the reservoir of the stopper is filled with the intended component or group of components. In general, it is filled with at least one acid which may be solid, such as citric acid, or liquid, such as acetic acid or hydrochloric acid. Once closed, the stopper can be stored and transported safely.

In a second stage, the container composed of a connector (9) and a pouch or a cartridge (not shown) is filled, through its filling opening (93), with another component or group of components of the composition of the dialysis solution. In general, notably, a solid concentrate containing glucose will be used. Once filling of the container has been completed, the filling opening (93) is sealingly closed with the previously filled stopper. The container thus closed can now be distributed to users, in general, hospitals or dialysis centers.

The container filled with a stopper can now be used in a dialysis machine.

To this effect, in a third stage, the container is connected to a dialysis machine, for example, by introducing its connecting portion or portions (91, 92) into the corresponding ports of the dialysis machine.

The opening of the reservoir (R1, R2, R3, R4) can be performed before, during or after connecting the container to the dialysis machine. The actuation of the opening means produces the opening through which the contents of the reservoir will be able to flow into the pouch or cartridge. The actuation of the opening means can be performed automatically by the dialysis machine after the container has been connected to the machine, or manually by the operator before or after the container has been connected. When the dialysis machine has a cover which is folded down onto the top of the connector in place to maintain the container during dialysis, this cover can also be used to actuate the opening means.

In a last step, once the contents of the reservoir have flowed into the container and the container has been connected to the dialysis machine, the solution-forming liquid can be introduced into the container and the concentrated solution thus formed is drawn and taken into the dialysis machine, as would be the case with a traditional concentrated solution.

Figure 16A:
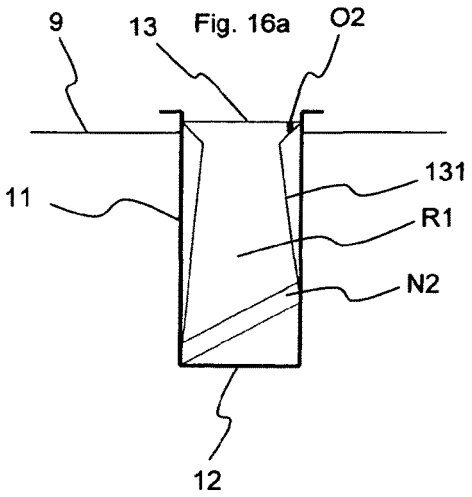
Figure 16B:
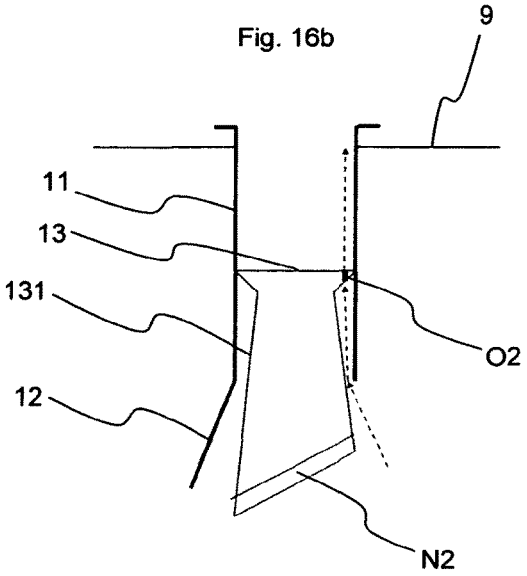

It may be useful in some cases to let air come into or out of the pouch or cartridge, for example, when water is introduced or when the solution is drawn. To this effect, several solutions have already been mentioned. For example, one of the introduction or extraction lines can serve as air inlet, or a third line dedicated to the passage of air can be provided in the connector (9). In the second and third embodiment of the stopper of the invention, recesses (245, 345) arranged at the top of the rods (24, 34) can be provided to allow air to circulate between the outside and the inside of the container or the cartridge via the stopper. In the case of the first embodiment, it is possible to provide a venting opening (O1, O2) in the upper radial wall (13) of the piston (B1), outside the second cylindrical wall (131). This solution is schematically shown in FIGS. 15 and 16. The cylindrical wall (131) of the piston (B1) is then provided with a sealing rib (N1, N2) which bears sealingly against the inner face of the cylindrical wall (11) of the housing (A1). The rib can extend in the area of the free end of the piston (FIG. 16*a/b*) or it can be substantially radial (FIG. 15*a/b*). Thus, when the piston (A1) has not yet been pushed down, the opening brings only the annular portion comprised between the two cylindrical walls (11, 131), the upper radial wall (13) and the sealing rib (N1, N2) in contact with the outside. Thus, the reservoir (R1) is isolated from the outside by this sealing rib. After the piston (B1) has been pushed down into the housing (A1), the free end of the piston comes to tear the lower radial wall (12) of the housing (A1) and the rib (N1, N2) comes out of the housing (A1). An air passage is thus produced between the opening (O1, O2), the annular portion between the two cylindrical walls (11, 131) and the outlet opening (128). This air passage is represented schematically by a dashed line. It allows entry or exit of air according to needs. The opening (O1, O2) can be connected to a source of purified or sterile air or it can be open to ambient air.

In an alternative embodiment of this venting opening, not shown, which is applicable to the four embodiments, it can be provided that the venting opening extends through the upper radial wall (13, 23, 33, 43) and opens directly into the reservoir (R1, R2, R3, R4). In this case, the venting opening must be closed by a removable cap that can be removed if needed at the time of actuating the means for producing the outlet opening.

The use of the stopper provided with a reservoir to close the introduction opening makes it possible to provide to dialysis patients an acidic concentrate in which the majority of components are solid. Because of the separation of the component s, the concentrate is stable. In addition, at most, only the contents of the reservoir of the stopper are in liquid form. Therefore, the operator only manipulates a container containing the necessary components for the solution, but not the solution-forming liquid. Thus, these containers are much lighter and easier to handle. Storage of these containers requires less space.

From an industrial point of view, it is possible to manufacture empty containers, with their filling channel open, in a first industrial site.

Filling of the stoppers can be performed in a second industrial site.

This way, empty containers and filled stoppers can be delivered to filling centers distributed around the world. In these centers, the containers are filled and the stoppers are put in place in the filling channels. The filled containers only need to be delivered to local markets.

This procedure can significantly reduce transportation and handling costs, because the distances travelled by the filled containers are limited. Only empty containers (thus, light and compact) and stoppers travel great distances.

List of references:

| | | | | |
|---|---|---|---|---|
| A1 | A2 | A3 | A4 | Housing |
| B1 | | | B4 | Piston |
| | B2 | B3 | | Lid |
| R1 | R2 | R3 | R4 | Reservoir |
| 10 | 20 | 30 | 40 | Stopper |
| 11 | 21 | 31 | 41 | Cylindrical wall |
| 111 | 211 | 311 | | Annular seal |
| 112 | 212 | 312 | 412 | Rim |
| | 213 | 313 | | Annular groove |
| | | | 414 | First sector |
| | | | 415 | Second sector |
| | | | 416 | Third sector/notch |
| 12 | 22 | 32 | 42 | Lower radial wall |
| | 221 | 321 | | Housing opening |
| | 222 | 322 | | Sleeve surrounding the housing opening |
| | 223 | | | Closure membrane |
| 124 | | | | Weakness zone |
| | | | 425 | Lower flange |
| | | | 426 | Annular seal |
| | | | 427 | Annular shoulder |
| 128 | 228 | 328 | 428 | Outer opening |
| 13 | 23 | 33 | 43 | Upper radial wall |
| 131 | | | | Second cylindrical wall |
| | 231 | 331 | | Lid opening |
| 132 | | | | Safety tab |
| | 232 | 332 | | Sleeve surrounding the lid opening |
| | 233 | 333 | | Cylindrical flange |
| | 234 | 334 | | Annular rib |
| | | | 435 | Upper flange |
| | | | 436 | Annular seal |
| | | | 437 | Knob |
| | | | 438 | Guide elements |
| | 24 | 34 | 44 | Rod |
| | 241 | 341 | | Knob |
| | 242 | 342 | | Lower end of the rod |
| | 243 | 343 | | First seal |
| | 244 | 344 | | Product outlet axial recesses |
| | 245 | 345 | | Air intake axial recesses |
| | | 346 | | Second seal |
| | 247 | | | Anti-extraction annular shoulder |
| | 25 | 35 | | Clip |
| 9 | | | | Connector for container |
| 91 | | | | Connecting portion |
| 92 | | | | Connection portion |
| 93 | | | | Opening to be closed |
| O1/O2 | | | | Venting opening |
| N1/N2 | | | | Sealing rib |

The invention claimed is:

1. Container containing a concentrate for dialysis, which container comprises a pouch or a cartridge containing a solid concentrate of constituents of the composition of the dialysis solution, and a connector sealingly closing the pouch or the cartridge, wherein the connector is provided with introduction and extraction means for introducing a solution-forming liquid into the pouch or cartridge and for extracting the solution obtained from the pouch or the cartridge, wherein the introduction and extraction means are provided with at least one connecting portion for connecting the introduction and extraction means to a corresponding port of the dialysis machine, a filling channel extending completely through the connector and intended for filling the pouch or the cartridge with the solid concentrate, and a stopper sealingly closing the filling channel, wherein the stopper is equipped with a reservoir containing a second constituent or group of constituents of the composition of the dialysis solution, wherein the reservoir is provided with a first cylindrical wall, a radial or oblique lower wall and a radial or oblique upper wall, wherein the upper wall closes an upper side of the cylindrical wall so as to form the reservoir in the space comprised within the cylindrical wall and between the lower and upper walls, and opening means for producing an outlet opening in the reservoir, wherein the outlet opening contacts the inside of the reservoir with the side of the stopper located in the container, wherein the opening means forms the outlet opening and the introduction and extraction means permit introducing a solution-forming liquid into the pouch or cartridge and extracting the solution obtained from the pouch or the cartridge without opening the filling channel;

wherein the reservoir is inserted in the filling channel so that the first cylindrical wall of the reservoir faces a cylindrical wall of the filling channel, and wherein at least one selected from the group consisting of:

(i) the first cylindrical wall is made of a compressible material dimensioned so that the first cylindrical wall is pressed against and matches exactly the cylindrical wall of the filling channel, and (ii) the first cylindrical wall has an annular seal that protrudes radially toward the cylindrical wall of the filling channel and is pressed against and matches exactly the cylindrical wall of the filling channel.

2. Container according to claim 1, wherein the reservoir contains an acid which is in liquid form.

3. Container according to claim 1, wherein the opening means are placed at least partly in the reservoir before the opening has been produced.

4. Container according to claim 1, wherein the introduction and extraction means comprise a fluid line for introducing a solution-forming liquid into the pouch or the cartridge, and a fluid line for extracting the solution obtained from the pouch or the cartridge, wherein each of the fluid lines extends from an orifice located in the pouch or the cartridge to a connecting portion located outside the container, the connecting portions being configured for connecting each of the fluid lines to a corresponding port of a dialysis machine.

5. Container according to claim 4, wherein the two fluid lines are combined into a single fluid line.

6. Container according to claim 1, wherein the opening means are designed to be displaced toward the inside of the container to produce the outlet opening.

7. Container according to claim 1, wherein the stopper is provided with blocking means for preventing the opening means from being actuated, wherein the blocking means can be removed or displaced to render them ineffective.

8. Container according to claim 1, wherein the stopper is provided in an upper portion thereof with means for limiting penetration of the stopper into the opening to a predetermined depth.

9. Container according to claim 8, wherein the means for limiting the penetration of the stopper into the opening are constituted by a radial rim whose dimensions are greater than the dimensions of the opening of the container.

10. Container according to claim 1, wherein anti-extraction means are provided to prevent extraction of the opening means from the stopper.

11. Container according to claim 10, wherein the anti-extraction means comprise a latch.

12. Container according to claim 1, wherein the stopper is constituted by a housing and a piston, the housing is constituted by the first cylindrical wall closed in the area of its lower edge by the lower wall, the lower wall has a weakness zone in the vicinity of a junction between the lower wall and the first cylindrical wall, the first cylindrical wall being provided in the area of an upper edge thereof with a radial rim oriented toward the outside whose dimensions are greater than the dimensions of the opening to be closed, the piston is constituted by a second cylindrical wall closed in the area of an upper edge thereof by a radial or oblique wall, called upper wall, the lower edge of the second cylindrical wall being beveled and inclined so that the height of the second cylindrical wall varies between a maximum height and a minimum height, a detachable safety tab is fixed on the periphery of the upper wall so as to surround the second cylindrical wall, the second cylindrical wall is dimensioned so that the second cylindrical wall can enter the first cylindrical wall and the safety tab is dimensioned so that the safety tab can bear against the rim when the piston is introduced into the housing so as to form the reservoir, the maximum height of the second cylindrical wall and the height of the safety tab are selected so that the difference between the maximum height of the second cylindrical wall and the height of the safety tab is less than the height of the first cylindrical wall measured between the lower wall and the rim, and the height of the first cylindrical wall measured between the lower wall and the rim is between the minimum height and the maximum height of the second cylindrical wall.

13. Container according to claim 12, wherein the lower wall has a weakness zone whose contours are identical to the cross section of the second cylindrical wall.

14. Container according to claim 1 arranged in a dialysis machine provided with one or more ports dimensioned to receive the connecting portion or portions of the connector.

15. Method of extemporaneous preparation of a dialysis solution in a dialysis machine provided with a container according to claim 1, wherein the following steps are performed:

a) putting the container in place in the dialysis machine and introducing the connecting portion or portions into the corresponding ports of the machine; and b) introducing the solution-forming liquid into the container via the introduction fluid means;

wherein the following additional steps are carried out prior to step a) or between step a) and step b):

c) actuating the opening means for producing an outlet opening in the reservoir contained in the stopper so as to produce the opening;

d) letting the contents of the reservoir flow into the pouch or the cartridge.

16. Method according to claim 15, wherein step c) is performed automatically by the dialysis machine after step a).

17. Method according to claim 15, wherein step c) is performed at the time of closing a retaining cover present in the dialysis machine and intended for retaining the container during the dialysis.

18. Method according to claim 15, wherein step c) is performed manually before or after step a).

19. Method according to claim 15, wherein the stopper contains an acid and/or the pouch or the cartridge contains a solid concentrate containing glucose.

20. Method according to claim 15, wherein the reservoir contains an acid which is in liquid form.

21. Method according to claim 15, wherein the reservoir contains an acid which is in solid form.

22. Method according to claim 15, wherein the reservoir contains an acid which is citric acid.

23. Container according to claim 1, wherein the reservoir contains an acid which is in solid form.

24. Container according to claim 1, wherein the reservoir contains an acid which is citric acid.

25. Container according to claim 1, wherein (i) the pouch contains a solid concentrate containing glucose and (ii) the reservoir of the stopper contains an acid.

26. Container according to claim 1, wherein the outlet opening is formed in the lower wall or at the junction between the lower wall and the first cylindrical wall.

27. Container according to claim 1, wherein a transverse cross-section of first the cylindrical wall is slightly less than a transverse cross-section of the filling channel, and wherein a radial rim protrudes outwardly from an upper edge of the filling channel, a transverse dimension of the outwardly oriented radial rim being greater than the transverse cross-section of the filling channel so that the radial rim rests on an upper edge of the filling channel.

* * * * *